US009784095B2

(12) United States Patent
Echols, III et al.

(10) Patent No.: US 9,784,095 B2
(45) Date of Patent: Oct. 10, 2017

(54) POSITION INDICATOR THROUGH ACOUSTICS

(71) Applicant: HALLIBURTON ENERGY SERVICES, INC., Houston, TX (US)

(72) Inventors: Ralph Harvey Echols, III, Rockwall, TX (US); William Mark Richards, Flower Mound, TX (US); Joshua Max Hornsby, Keller, TX (US); Gregory William Garrison, Dallas, TX (US); James Ho, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 203 days.

(21) Appl. No.: 14/414,159

(22) PCT Filed: Dec. 30, 2013

(86) PCT No.: PCT/US2013/078341
§ 371 (c)(1),
(2) Date: Jan. 12, 2015

(87) PCT Pub. No.: WO2015/102582
PCT Pub. Date: Jul. 9, 2015

(65) Prior Publication Data
US 2016/0273349 A1 Sep. 22, 2016

(51) Int. Cl.
*G01V 1/44* (2006.01)
*E21B 47/09* (2012.01)
(Continued)

(52) U.S. Cl.
CPC ..... *E21B 47/091* (2013.01); *E21B 23/02* (2013.01); *E21B 47/09* (2013.01); *E21B 47/14* (2013.01); *E21B 47/18* (2013.01)

(58) Field of Classification Search
CPC ..... E21B 23/02; E21B 47/09; E21B 47/18; E21B 47/14; E21B 47/00; E21B 47/122; E21B 47/16; G01V 1/44
(Continued)

(56) References Cited

U.S. PATENT DOCUMENTS 4,945,775 A 8/1990 Adams et al.
5,275,038 A 1/1994 Sizer et al.
(Continued)

FOREIGN PATENT DOCUMENTS

EP 1096271 5/2001
EP 1096272 5/2001
(Continued)

OTHER PUBLICATIONS

Acoustic Telemetry System, Halliburton Testing and Subsea, 2010, 4 pages.
(Continued)

*Primary Examiner* — Daniel L Murphy
(74) *Attorney, Agent, or Firm* — Kilpatrick Townsend & Stockton LLP

(57) ABSTRACT

Assemblies and methods of use are disclosed for determining a position of a body within a tubing section. A signal generator coupled to the body is operable to generate a pressure wave in response to detecting a detectable portion of the tubing section when the body is moved relative to the tubing section.

9 Claims, 18 Drawing Sheets

(51) Int. Cl.
*E21B 23/02* (2006.01)
*E21B 47/18* (2012.01)
*E21B 47/14* (2006.01)

(58) Field of Classification Search
USPC ..... 367/25
See application file for complete search history.

(56) References Cited

U.S. PATENT DOCUMENTS

| | | | |
|---|---|---|---|
| 5,419,188 | A | 5/1995 | Rademaker et al. |
| 5,579,842 | A | 12/1996 | Riley |
| 5,666,050 | A | 9/1997 | Bouldin et al. |
| 5,925,879 | A | 7/1999 | Hay |
| 6,018,501 | A | 1/2000 | Smith et al. |
| 6,075,461 | A | 6/2000 | Smith |
| 6,177,882 | B1 | 1/2001 | Ringgenberg et al. |
| 6,268,911 | B1 | 7/2001 | Tubel et al. |
| 6,269,198 | B1 | 7/2001 | Hodgson et al. |
| 6,288,975 | B1 | 9/2001 | Frederick et al. |
| 6,481,495 | B1 | 11/2002 | Evans |
| 6,724,319 | B1 | 4/2004 | Knaack et al. |
| 6,728,165 | B1 | 4/2004 | Roscigno et al. |
| 6,769,805 | B2 | 8/2004 | Williams et al. |
| 6,787,758 | B2 | 9/2004 | Tubel et al. |
| 6,828,547 | B2 | 12/2004 | Tubel et al. |
| 6,913,079 | B2 | 7/2005 | Tubel |
| 6,915,686 | B2 | 7/2005 | Baustad |
| 6,943,340 | B2 | 9/2005 | Tubel et al. |
| 6,978,832 | B2 | 12/2005 | Gardner et al. |
| 7,028,543 | B2 | 4/2006 | Hardage et al. |
| 7,040,390 | B2 | 5/2006 | Tubel et al. |
| 7,054,011 | B2 | 5/2006 | Zhu et al. |
| 7,201,221 | B2 | 4/2007 | Tubel et al. |
| 7,201,231 | B2 | 4/2007 | Chaplin et al. |
| 7,219,729 | B2 | 5/2007 | Bostick, III et al. |
| 7,228,900 | B2 | 6/2007 | Schultz et al. |
| 7,240,738 | B2 | 7/2007 | Pendleton |
| 7,245,382 | B2 | 7/2007 | Ronnekleiv |
| 7,254,999 | B2 | 8/2007 | Bostick, III |
| 7,278,480 | B2 | 10/2007 | Longfield et al. |
| 7,284,606 | B2 | 10/2007 | Coronado |
| 7,357,021 | B2 | 4/2008 | Blacklaw |
| 7,417,920 | B2 | 8/2008 | Hahn et al. |
| 7,436,320 | B2 | 10/2008 | Miller, Jr. |
| 7,565,834 | B2 | 7/2009 | Adnan et al. |
| 7,740,064 | B2 | 6/2010 | McCoy et al. |
| 7,797,996 | B2 | 9/2010 | Bostick, III |
| 7,857,066 | B2 | 12/2010 | DiFoggio et al. |
| 7,881,155 | B2 | 2/2011 | Close |
| 7,932,834 | B2 | 4/2011 | Beique et al. |
| 7,946,341 | B2 | 5/2011 | Hartog et al. |
| 7,982,632 | B2 | 7/2011 | Miller, Jr. |
| 7,997,340 | B2 | 8/2011 | Bostick, III et al. |
| 8,109,333 | B2 | 2/2012 | Yee |
| 8,237,443 | B2 | 8/2012 | Hopmann et al. |
| 8,430,163 | B2 | 4/2013 | Dupont |
| 2001/0042617 | A1 | 11/2001 | Beck et al. |
| 2002/0092649 | A1 | 7/2002 | Bixenman et al. |
| 2002/0104652 | A1 | 8/2002 | Cole et al. |
| 2003/0102980 | A1 | 6/2003 | Koro et al. |
| 2003/0205083 | A1 | 11/2003 | Tubel et al. |
| 2004/0043501 | A1 | 3/2004 | Means et al. |
| 2004/0140092 | A1 | 7/2004 | Robison |
| 2004/0156265 | A1 | 8/2004 | Lavrut et al. |
| 2004/0163809 | A1 | 8/2004 | Mayeu et al. |
| 2004/0194958 | A1 | 10/2004 | Mayeu et al. |
| 2005/0012036 | A1 | 1/2005 | Tubel et al. |
| 2005/0062979 | A1 | 3/2005 | Zhu et al. |
| 2005/0263279 | A1 | 12/2005 | Vachon et al. |
| 2006/0081413 | A1 | 4/2006 | Minto |
| 2007/0012460 | A1 | 1/2007 | Coronado |
| 2007/0139217 | A1 | 6/2007 | Beique et al. |
| 2007/0285274 | A1 | 12/2007 | Esmersoy |
| 2008/0264631 | A1 | 10/2008 | Mendez et al. |
| 2008/0294344 | A1 | 11/2008 | Sugiura |
| 2009/0034368 | A1 | 2/2009 | Johnson |
| 2009/0071645 | A1 | 3/2009 | Kenison et al. |
| 2009/0128141 | A1 | 5/2009 | Hopmann et al. |
| 2009/0188665 | A1 | 7/2009 | Tubel et al. |
| 2009/0199630 | A1 | 8/2009 | DiFoggio et al. |
| 2009/0201764 | A1 | 8/2009 | Liu |
| 2009/0301184 | A1 | 12/2009 | Irani et al. |
| 2010/0013663 | A1 | 1/2010 | Cavender et al. |
| 2010/0018303 | A1 | 1/2010 | Bostick, III |
| 2010/0166358 | A1 | 7/2010 | Homa et al. |
| 2010/0303426 | A1 | 12/2010 | Davis |
| 2010/0309019 | A1 | 12/2010 | Shah et al. |
| 2011/0163891 | A1 | 7/2011 | Wilson et al. |
| 2011/0280105 | A1 | 11/2011 | Hall et al. |
| 2012/0037360 | A1 | 2/2012 | Arizmendi, Jr. et al. |
| 2012/0046866 | A1 | 2/2012 | Meyer et al. |
| 2012/0080231 | A1 | 4/2012 | Radford et al. |
| 2012/0147924 | A1 | 6/2012 | Hall |
| 2012/0152562 | A1 | 6/2012 | Newton et al. |
| 2012/0175135 | A1 | 7/2012 | Dyer et al. |
| 2012/0176250 | A1 | 7/2012 | Duncan et al. |
| 2012/0211231 | A1 | 8/2012 | Erkol et al. |
| 2012/0256635 | A1 | 10/2012 | Gissler |
| 2012/0286967 | A1 | 11/2012 | Alteirac et al. |
| 2013/0016979 | A1 | 1/2013 | Duncan et al. |
| 2013/0021874 | A1 | 1/2013 | Hartog et al. |
| 2013/0075161 | A1 | 3/2013 | Yang |
| 2013/0087328 | A1 | 4/2013 | Maida, Jr. et al. |
| 2014/0014329 | A1* | 1/2014 | Radford ..... E21B 47/00 166/250.01 |
| 2014/0251603 | A1 | 9/2014 | Raducanu et al. |
| 2015/0077265 | A1 | 3/2015 | Gao et al. |
| 2015/0167430 | A1* | 6/2015 | Purkis ..... E21B 23/04 166/373 |

FOREIGN PATENT DOCUMENTS

| | | |
|---|---|---|
| EP | 1096273 | 5/2001 |
| GB | 2364380 | 1/2002 |
| GB | 2436473 | 9/2007 |
| WF | 2015069214 | 5/2015 |
| WO | 9850681 | 11/1998 |
| WO | 9857030 | 12/1998 |
| WO | 03017538 | 2/2003 |
| WO | 2015069214 | 5/2015 |
| WO | 2015099641 | 7/2015 |
| WO | 2015112127 | 7/2015 |

OTHER PUBLICATIONS

Bumper Spring with Collet Latch, Ferguson Bearegard, 2012, 1 page.

Fiber Optic Sensing Technologies for Well Monitoring to Reservoir Management, Pinanacle, 2012, 7 Pages.

Permanent Downhole Monitoring, Weatherford, 2006, 16 pages.

SureView Real-Time Fiber-Optic Compaction Monitoring System, The SureView RTCM system Baker Hughes, 2010, 4 pages.

Andren et al., "Integrated Ocean Drilling Program", Expedition 347 Scientific Prospectus, 61 pages, 2012.

Camwell et al., "Acoustic Telemetry, with Multiple Nodes in Drillstring, used to Achieve Distributed MWD", Innovating While Drilling, Mar./Apr. 2009, pp. 1-6.

Dria , "E&P Applications of Fiber Optic Technologies", Myden Energy Consulting PLLC, May 2012, 47 pages.

Fernandez et al.,"Drilling system using mud actuated down hole hammer as primary engine", Novatek, Report #34365R05, 35 pages, 2005.

Harper et al., "Advanced Acoustic Telemetry System Provides Real-time Data Acquisition that Increases Efficiency in Well Testing Operations", Offshore Technology Conference, May 5-8, 2003, 16 pages.

Lienau , "Direct-Use Downhole Pumps", Geo-Heat Center Quarterly Bulletin vol. 8, No. 3, 1984, 7 Pages.

International Patent Application No. PCT/US2013/078341 , International Search Report and Written Opinion, mailed Oct. 10, 2014, 15 pages.

(56) References Cited

OTHER PUBLICATIONS

Skinner et al., "Downhole Fiber-optic Sensing: The Oilfield Service Provider's Perspective", Halliburton Energy Services, Fiber Optic Sensor Technology and Applications III, Proc. of SPIE vol. 5589, 2004, pp. 206-220.
Wassermann et al., "How High-Speed Telemetry Affects the Drilling Process", JPT, Jun. 2009, 4 pages.
EM Telemetry Tool for Deep Well Drilling Applications, Deep Trek Program Solicitation, E-Spectrum Technologies, Inc., available to the public at least as early as May 21, 2013, 2 pages.
Permanent Downhole Monitoring Solutions, Promore, Core Lab Reservoir Optimization www.promore.com, available to the public at least as early as May 21, 2013, 2 pages.

* cited by examiner

POSITION INDICATOR THROUGH ACOUSTICS

CROSS-REFERENCE TO RELATED APPLICATIONS

This is a U.S. national phase under 35 U.S.C. 371 of International Patent Application No. PCT/US2013/078341, titled "Position Indicator Through Acoustics" and filed Dec. 30, 2013, the entirety of which is incorporated herein by reference.

TECHNICAL FIELD

The present disclosure relates generally to indication of tool position in a well completion.

BACKGROUND

Oilfield operations can involve the use of various tools in a downhole environment located at a significant distance from a tool operator. During use, tools can need to be positioned in exact locations in a well. Failure to properly position tools in a well can cause significant and costly problems, including undesired damage to the tool and/or wellbore. It can be desirable to determine a position of a tool before performing additional operations. It can be difficult to obtain information about the position of tools used downhole. Accurate positioning of tools can be further desirable in wells having multizone completions.

DETAILED DESCRIPTION

Figure 1:
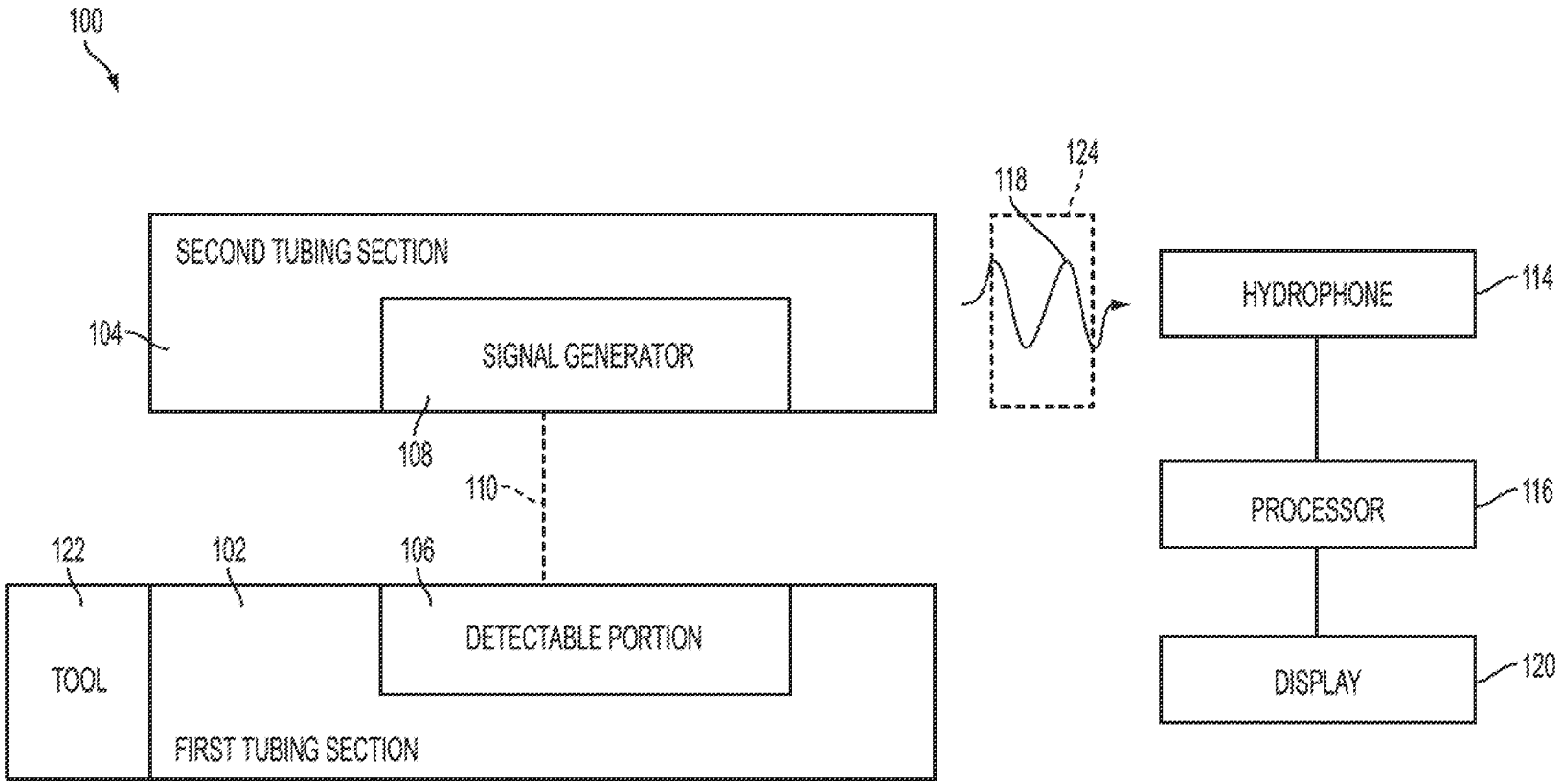
FIG. 1 is a block diagram of a system for determining a position of a tubing section according to one aspect.

Certain aspects and features relate to methods and assemblies for determining a position of a tubing string or section of a tubing string downhole in a wellbore. In one aspect a recognizable signal can be generated downhole. The recognizable signal can be received at surface or on the rig floor and can indicate the position of a body relative to a tubing section.

The recognizable signal can be generated by a signal generator. A signal generator may be any device or assembly used to electrically or mechanically generate a signal used to indicate a tool's position. The signal generator can generate a pressure wave, such as a sound wave, upon being triggered. In one aspect, the signal generator can be a slidable mass contacting a shoulder of a tubing section to generate a pressure wave. In one aspect, the signal generator can be a spring-biased hammer contacting a solid shoulder to generate a pressure wave. In one aspect, the signal generator can be an electronic signal generator, controlled by a logic circuit board or a processor, that produces a sound. In one aspect, the signal generator can be an atmospheric chamber being flooded that results in a detectable sound. In one aspect, the signal generator can be a collet or other device passing over a profile of grooves, generating sounds as the collet or other device snaps into the grooves.

In some aspects, the signal generator can located on a first tubing string or a section thereof and can be triggered when a detectable portion of a second tubing section passes by the signal generator a part thereof. The detectable portion can interact with or be detected by the signal generator, thus triggering generation of the recognizable signal. The first tubing section can be positioned downhole relative to a second tubing section. The first tubing section can be a work string that is maneuverable relative to the second tubing section. The second tubing section can be a completion string that can remain downhole for the life of the well. In some aspects, the signal generator can be located on the second tubing section and the detectable portion can be located on the first tubing section. In some aspects, the second tubing section can be a work string maneuverable relative to a first tubing section, such as a completion string. As used herein, the term "body" may be used to refer to one of a first tubing section, a second tubing section, or a downhole tool.

The recognizable signal can be repeatable. The recognizable signal can be received at the surface of the wellbore by a hydrophone or similar device capable of receiving pressure wave. The hydrophone's receipt of the pressure wave can indicate the position of the tubing section.

In one aspect, the detectable portion is a detent mechanism. A detent can be a device or structure designed to provide mechanical pressure on another device or structure. The detent mechanism can be a snap ring, collet, or spring loaded detent that can be positioned around an outer surface of a first tubing section. The signal generator can include a slidable mass positioned within a recess on an inner surface of the second tubing section at a desired location. The slidable mass can be coupled to the second tubing section by a biasing device such as a spring or Belleville washer. The biasing device can be configured to give the signal generator a predetermined release load. As a first tubing section moves relative to a second tubing section, the detent mechanism can cause a mechanism on the second tubing section to generate a pressure wave. Examples of the mechanism generating the pressure wave can include a spring loaded hammer, a slidable mass in a profile, and a lug.

In some aspects the signal generator can be an electronic signal generator connected to a logic circuit board or a processor, both located in a recess of the first tubing section. In one aspect, the detectable portion is a passive or active RFID located in a recess of or on the second tubing section and the signal generator includes a sensor configured to detect the proximity of the passive or active RFID. In one aspect, detectable portion is a reflective surface located in a recess of or on the second tubing section and the signal generator includes a sensor configured to detect light reflected off the reflective surface. In some aspects, the reflective surface can be highly reflective to a specific wavelength and the sensor is configured to substantially only detect that specific wavelength, such that the signal generator does not generate a pressure wave when it passes other reflective surfaces not highly reflective to the specific wavelength. In some aspects, the reflective surface can be highly reflective to a specific wavelength and the signal generator can be configured to generate a particular pressure wave correlated to the particular reflective surface sensed, based on which specific wavelength was detected by the sensor.

In one aspect, the signal generator can be an atmospheric chamber located in the second tubing section and can have a port sealable by a moveable collet or other cover. A detectable portion of the first tubing section can contact the moveable collet or other cover and cause it to open the port, thus allowing the atmospheric chamber to be flooded. The sound of the atmospheric chamber being flooded can result in a detectable pressure wave. In one aspect, moving the moveable collet or other cover can result in the opening of a plurality of ports to a plurality of respective atmospheric chambers, thus generating a pattern of detectable pressure waves.

In one aspect, the signal generator can be a collet located on a first tubing section and the detectable portion can be profile of grooves on a second tubing section. The collet can be configured to be biased such that it snaps into each groove as it passes the profile of grooves. A pattern of detectable pressure waves can be generated as the collet passes over the profile of grooves.

In some aspects, a second tubing section can include multiple signal generators and a first tubing section can include at least one detectable portion. In such aspects, the signal generators can be positioned in patterns along the second tubing section such that a detectable pattern of pressure waves is generated when the second tubing section moves in relation to the first tubing section. In some aspects, multiple detectable portions can be positioned in patterns along the first tubing section and a second tubing section can include at least one signal generator. A detectable pattern of pressure waves can be generated when the second tubing section moves in relation to the first tubing section, as the signal generator is triggered by the plurality of detectable portions.

The pressure wave can travel to the surface and be detected by a hydrophone or other device capable of measuring a pressure wave. In one aspect, the pressure wave can be detected by the human ear or by touch. In one aspect, the pressure wave can travel through the formation fluid to the surface. In another aspect, the pressure wave can travel through the second tubing section to the surface. The hydrophone can indicate that the pressure wave was detected. The hydrophone's detection of the pressure wave can indicate that the first tubing section is at a specific location downhole relative to the second tubing section. The specific location can be known based on the known locations of the detectable portion within or on its tubing section and the signal generator within or on its tubing section. Detection by a hydrophone or other device capable of measuring a pressure wave can cause a display or annunciator panel to update. Detection of a particular pattern of pressure waves can cause a display, such as a computer monitor or annunciator panel, to update with identifying information correlating to the particular pattern of pressure waves detected. Such identifying information can include the location of the signal generator, location of the detectable portion, or the location of a tool attached to the first tubing section.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

FIG. 1 is a schematic view depicting a position indicator system 100 including a first tubing section 102 and a second tubing section 104. The first tubing section 102 can include a detectable portion 106. The first tubing section can include a tool 122. In some aspects, the tool 122 may instead be included on the second tubing section. As used herein, any elements locatable on or in either a first tubing section 102 or a second tubing section 104 can instead be locatable on or in a tool 122. The second tubing section 104 includes a signal generator 108 coordinating with the detectable portion 106. A signal generator 108 and detectable portion 106 are said to be coordinating if the signal generator 108 is capable of generating a pressure wave 118 upon being triggered by the detectable portion 106. The detectable portion 106 can trigger the signal generator 108 via a triggering event 110. The triggering event 110 can be an event that involves physical contact between the tubing sections 102, 104 or an event that involves the tubing sections 102, 104 being in proximity to one another without physical contact occurring. Examples of a triggering event 110 involving physical contact can include mechanical pressure applied to or by the detectable portion, as described in further detail herein. Examples of a triggering event 110 that do not involve physical contact can include reflection of light, an RF link, or other similar triggering event without mechanical pressure, as described in further detail herein. The pressure wave 118 can be conducted to a hydrophone 114 through an acoustically conductible medium 124. The acoustically conductible medium 124 can include the production fluid, the second tubing section 104, and/or any other medium capable of conducting pressure waves. The hydrophone 114 can be acoustically connected to the signal generator 108 via the acoustically conductible medium 124. Any sensor capable of detecting pressure waves can be utilized wherever the term "hydrophone" is used herein. In some aspects, the hydrophone or similar device is located downhole and/or incorporated into a downhole tool connected to the surface via wire.

Although FIG. 1 depicts a tool 122 deployed via a tubing section 102 having a detectable portion 106, other implementations are possible. Any configuration involving relative movement between a signal generator 108 (included in one of a moving tool string or station tubing section) and a detectable portion 106 (included in the other of a moving tool string or station tubing section) can be used as discussed herein. For example, a tool 122 may be included in a tool string deployed via wireline that includes a signal generator 108.

The hydrophone 114 can be connected to a processor 116 that is connected to a display 120. Upon receipt of the pressure wave 118 by the hydrophone 114, the processor 116 can cause the display 120 to indicate the position of at least one of the first tubing section 102, detectable portion 106, second tubing section 104, signal generator 108, or a tool 122.

In some aspects, the signal generator 108 is repeatable, meaning that the signal generator 108 is capable of resetting itself to generate further pressure waves 118 without human intervention. In some aspects, the signal generator 108 is partially repeatable, meaning that the signal generator 108 is capable of resetting itself a finite number of times before human intervention is necessary. In some aspects, the signal generator 108 is fully repeatable, meaning that the signal generator 108 is capable of resetting itself indefinitely, barring mechanical failure.

Figure 2:
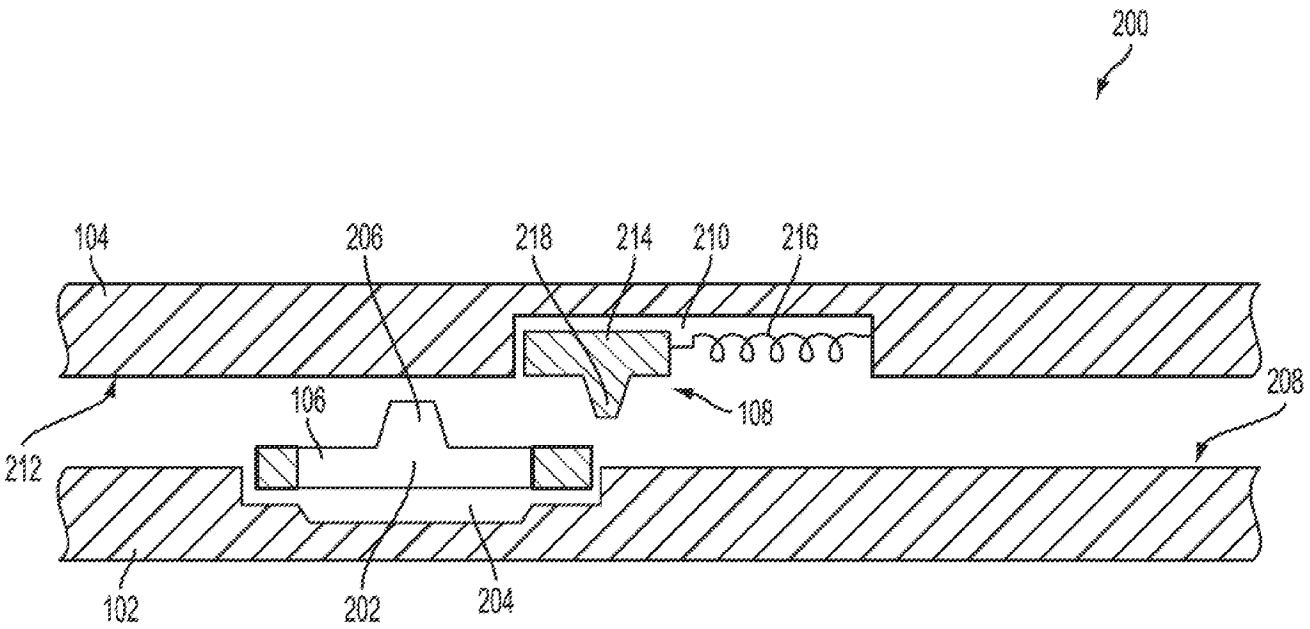
FIG. 2 is a cross-sectional view of part of a tubing assembly for determining a position of a tubing section according to one aspect.

In some aspects, a signal indicating a position of a tool can be mechanically created by a slidable mass 214. FIG. 2 depicts a cross-sectional view of part of a tubing assembly 200 that includes the first tubing section 102 positioned relative to the second tubing section 104 downhole in a wellbore. The first tubing section 102 has a detectable portion 106 that is a detent mechanism 202, such as a collet. In other aspects, the detent mechanism 202 can be a snap ring, a spring loaded detent, or other suitable device. The detent mechanism 202 is positioned within a recess on an outer surface 204 of the first tubing section 102. The detent mechanism 202 includes a projection 206 that extends beyond the outer surface 208 of the first tubing section 102.

The second tubing section 104 has a signal generator 108 positioned at a known location along the length of the second tubing section 104. The signal generator 108 is positioned within a recess 210 on an inner surface 212 of the second tubing section 104. The signal generator 108 includes a slidable mass 214 coupled to a spring 216. The slidable mass 214 includes a projection 218 extending beyond the inner surface 212 of the second tubing section 104. In other aspects, the spring 216 can be any suitable biasing device, for example, but not limited to, a Belleville washer. The spring 216 can provide a predetermined biasing force set such that the signal generator 108 can generate a pressure wave when a certain load is applied to the projection 218. The projection 206 of the detent mechanism 202 can contact the projection 218 of the slidable mass 214 as the first tubing section 102 is maneuvered downhole relative to the second tubing section 104 towards the spring 216.

Figure 3:
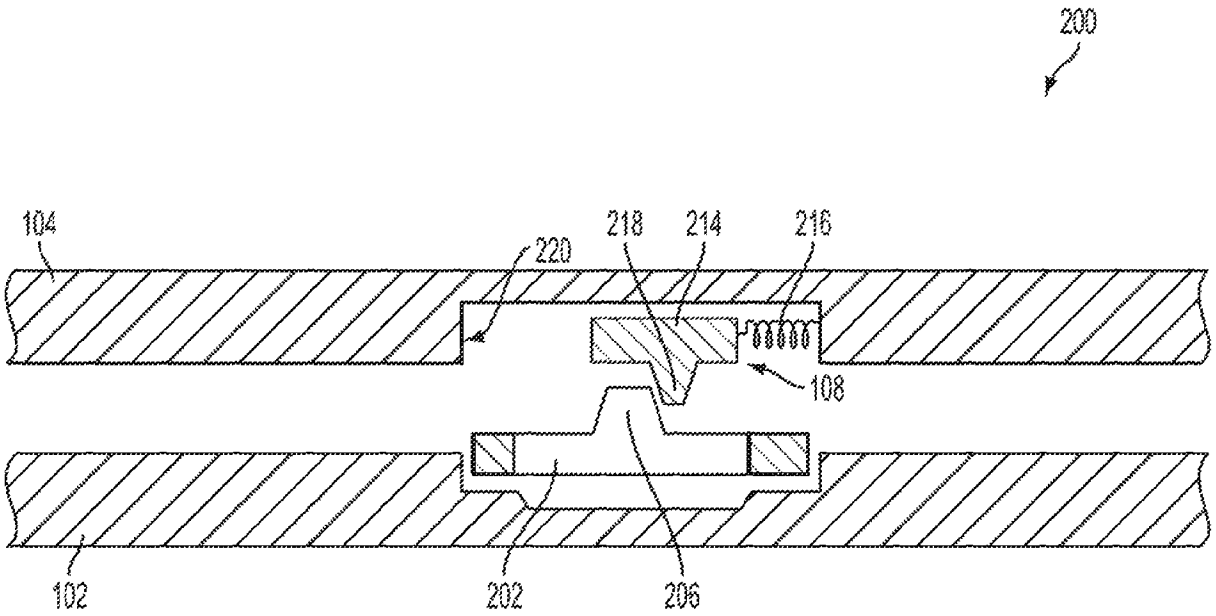
FIG. 3 is a cross-sectional view of part of the tubing assembly of FIG. 2 in which a projection engages a slidable mass generating a signal indicative of the determining position of the tubing section according to one aspect.

FIG. 3 depicts a cross-sectional view of part of a tubing assembly 200 with the projection 206 of the detent mechanism 202 contacting the projection 218 of the slidable mass 214, causing the spring 216 to compress. The projection 206 of the detent mechanism 202 can contact and urge the projection 218 of the slidable mass 214 towards the spring 216 as the first tubing section 102 is moved relative to the second tubing section 104. The spring 216 can compress as the detent mechanism 202 urges the slidable mass 214 towards the spring 216. The projection 206 of the detent mechanism 202 can slide over and past the projection 218 of the slidable mass 214 when the force of the detent mechanism 202 against the slidable mass 214 exceeds the predetermined release load of the signal generator 108. The spring 216 can uncompress and exert a force on the slidable mass 214 when the projection 206 of the detent mechanism 202 slides past and releases the projection 218 of the slidable mass 214.

Figure 4:
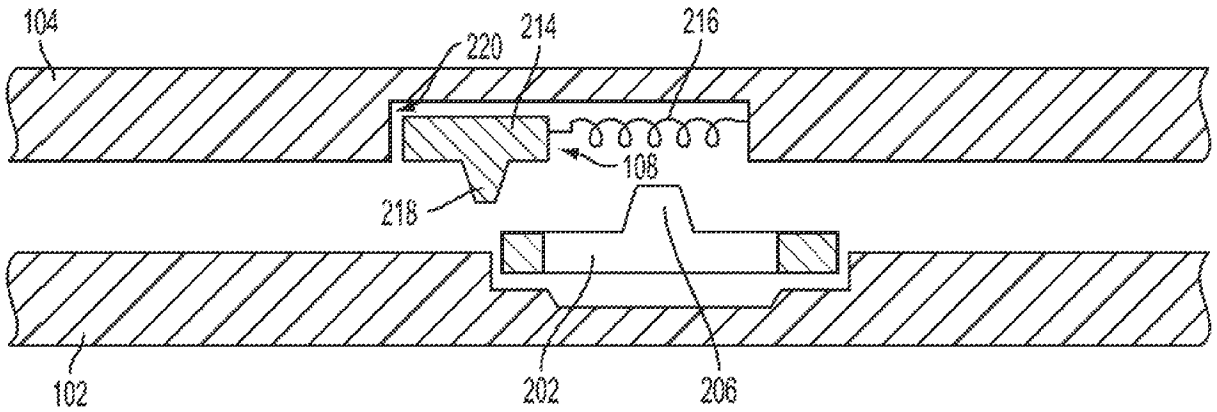
FIG. 4 is a cross-sectional view of part of the tubing assembly of FIG. 2 in which a slidable mass impacts a shoulder of a tubing section according to one aspect.

FIG. 4 depicts a cross-sectional view of part of the tubing assembly 200 with the detent mechanism 202 forced past the slidable mass 214 and the slidable mass 214 contacting a solid shoulder 220 of the second tubing section 104. When sufficient force is exerted against the slidable mass 214 by the detent mechanism 202, at least one of the detent mechanism 202 and slidable mass 214 flexes or is displaced radially in order to allow the projection 206 of the detent mechanism 202 to move past the projection 218 of the slidable mass 214. The spring 216 can expand when the projection 206 of the detent mechanism 202 moves past the projection 218 of the slidable mass 214. The spring 216 can exert a force on the slidable mass 214 as the spring 216 expands. The slidable mass 214 can be moved along an axis in the direction of the force exerted by the expansion of the spring 216. The slidable mass 214 can continue along the axis and contact a solid shoulder 220 of the second tubing section 104. A pressure or sound wave can be generated by the slidable mass 214 contacting the solid shoulder 220. The generation of the pressure wave can indicate that the first tubing section 102 is at a specific location or has passed the specific location with respect to the second tubing section 104.

Figure 5A:
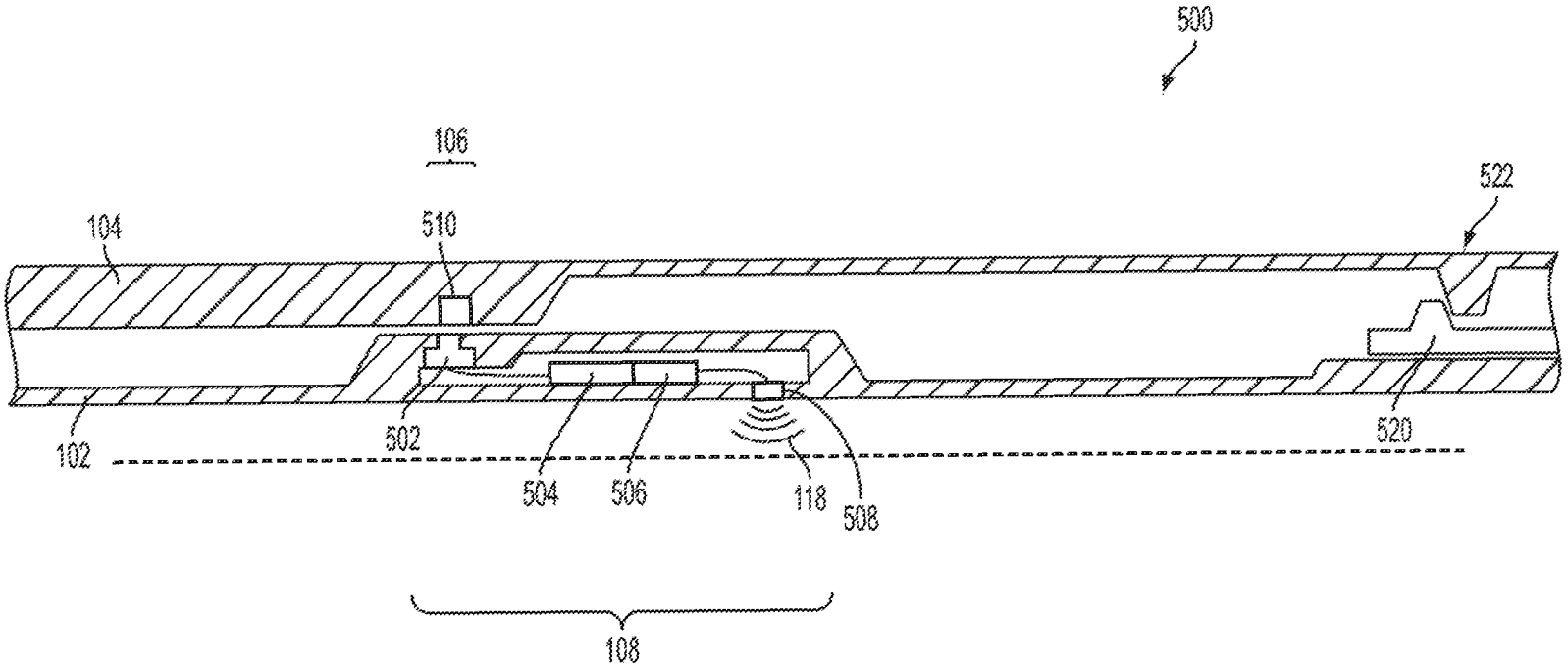
FIG. 5*a* is a cross-sectional view of part of a tubing assembly for determining a position of a tubing section with an electronic signal generator and a magnetic sensor, according to one aspect.

In alternative aspects, a signal indicating a position of a tool or tubing section can be electrically generated. FIG. 5*a* is a cross sectional depiction of a part of tubing assembly 500 having a first tubing section 102 including a signal generator 108 that includes a magnetic sensor 502, such as a hall effect sensor or a giant magnetoresistive sensor. The signal generator 108 further includes a processor 504, a power supply 506, and an electronic signal generator 508. The electronic signal generator 508 can be any device capable of converting an electronic signal into a pressure wave, such as a loudspeaker or piezoelectric device. The tubing assembly 500 includes a second tubing section 104 with a detectable portion 106. The detectable portion 106 includes a magnet 510. The processor 504 can be configured to cause the electronic signal generator 508 to create an pressure wave 118 in response to the magnetic sensor 502 detecting the proximity of a magnetic field. As the first tubing section 102 is moved relative to the second tubing section 104, the magnetic sensor 502 can pass by the magnet 510, resulting in the generation of a pressure wave 118 that is indicative of the position of the first tubing section 102 relative to the second tubing section 104. The processor 504 can be configured to generate a pressure wave 118 that includes a special pulsed signal that can be more easily distinguished, at the surface, from other noise. In some aspects, the processor 504 can further configure the electronic signal generator 508 to generate a pressure wave 118 that includes a special pulsed signal correlated to the detectable portion 106. Such a special pulsed signal can be a unique signal.

Figure 5B:
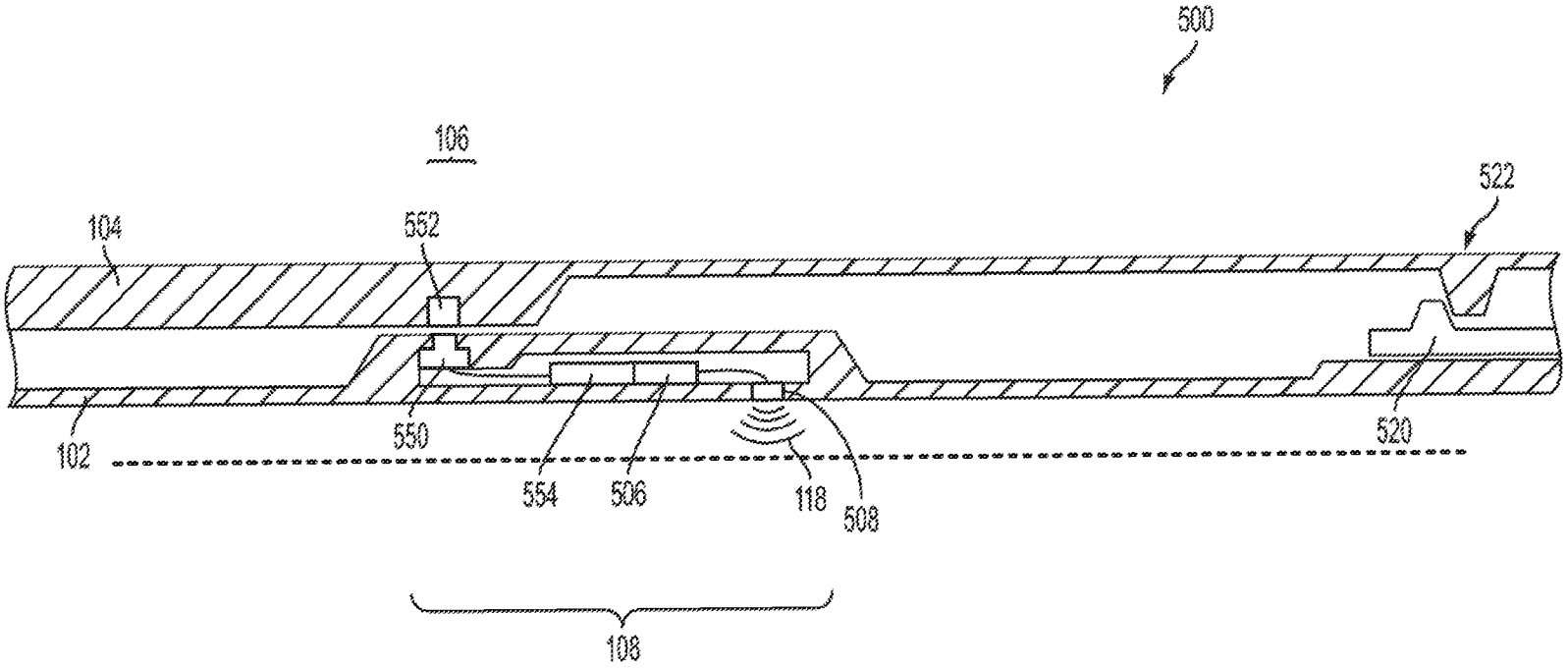
FIG. 5*b* is a cross-sectional view of part of a tubing assembly for determining a position of a tubing section with an electronic signal generator and an RFID sensor, according to one aspect.

In alternative aspects, a signal indicating a position of a tool or tubing section can be electrically generated. FIG. 5*b* is a cross sectional depiction of a part of tubing assembly 500 having a first tubing section 102 including a signal generator 108 that includes an radio frequency identification ("RFID") sensor 550. The detectable portion 106 can include an active or passive RFID tag 552. The RFID sensor 550 can be capable of detecting the proximity of the active or passive RFID tag 552. In such an embodiment, a processor 554 can be configured to have the electronic signal generator 508 generate a pressure wave 118 in response to the RFID sensor 550 passing the RFID tag 552. In some aspects, the RFID tag 552 can actively or passively transmit additional identifying information to the RFID sensor 550. The additional identifying information can include a serial number, position information, or other information. In some aspects, the processor 554 can be configured to generate a pressure wave 118 that includes a special pulsed signal correlated to the additional identifying information. As used herein, a special pulsed signal that is correlated to the additional identifying information can include the additional identifying information or can be a unique signal otherwise recognizable as associated with the additional identifying information. In such aspects, the additional information can be conducted to the surface and the processor 116 at the surface can utilize the additional information to update a display 120 or perform some other action.

In some aspects, a unique signal can be generated that is used to identify where, at a number of predetermined locations within a tubing section, a body is located. The use of these unique signals can allow a user to identify a specific zone of a multi-zone completion in which the tool 122 is located. For example, a sensor 550 in communication with the processor 554 can sense the proximity of a first detectable portion of a tubing string or a section thereof. The processor 554 can receive data from the sensor 552 and configure the electronic signal generator 508 to generate a first pressure wave 118 or other signal. The first pressure wave 118 or other signal can correspond to or otherwise indicate a first location of a body of the tool 122 relative to a tubing string or a section thereof (e.g., a first zone of a multi-zone completion). The sensor 550 in communication with the processor 554 can subsequently sense the proximity of a second detectable portion of a tubing string or a section thereof. The processor 554 can receive data from the sensor 550 and configure the electronic signal generator 508 to generate a second pressure wave or other signal that can be differentiated from the first pressure wave or other signal. The second pressure wave or other signal can correspond to or otherwise indicate a second location of a body of the tool 122 relative to a tubing string or a section thereof (e.g., a second zone of a multi-zone completion).

In one aspect, as depicted in both FIGS. 5*a*-5*b*, the first tubing section 102 can include a weigh down collet 520 and the second tubing section 104 can include an indicator 522. Although depicted in FIGS. 5*a*-5*b*, the weigh down collet 520 and indicator 522 as described herein can be utilized with other aspects described herein. The weigh down collet 520 can be located at a position deeper in a well bore than the signal generator 108. The indicator 522 can be located at a position deeper in the well bore than the detectable portion 106. The distance between the detectable portion 106 and the indicator 522 can be approximately equivalent to the distance between the signal generator 108 and the weigh down collet 520. The weigh down collet 520 can locate and disengage the indicator 522. A multi-zone completion assembly can have multiple indicators 522 corresponding to multiple zones. The use of a signal generator 108 in addition to a weigh down collet 520 can assist a tool operator in determining the position of the first tubing section 102 with respect to the second tubing section 104. The signal generator 108 can additionally help diagnose problems with the weigh down collet 520 should it not properly locate the indicator 522.

Figure 6:
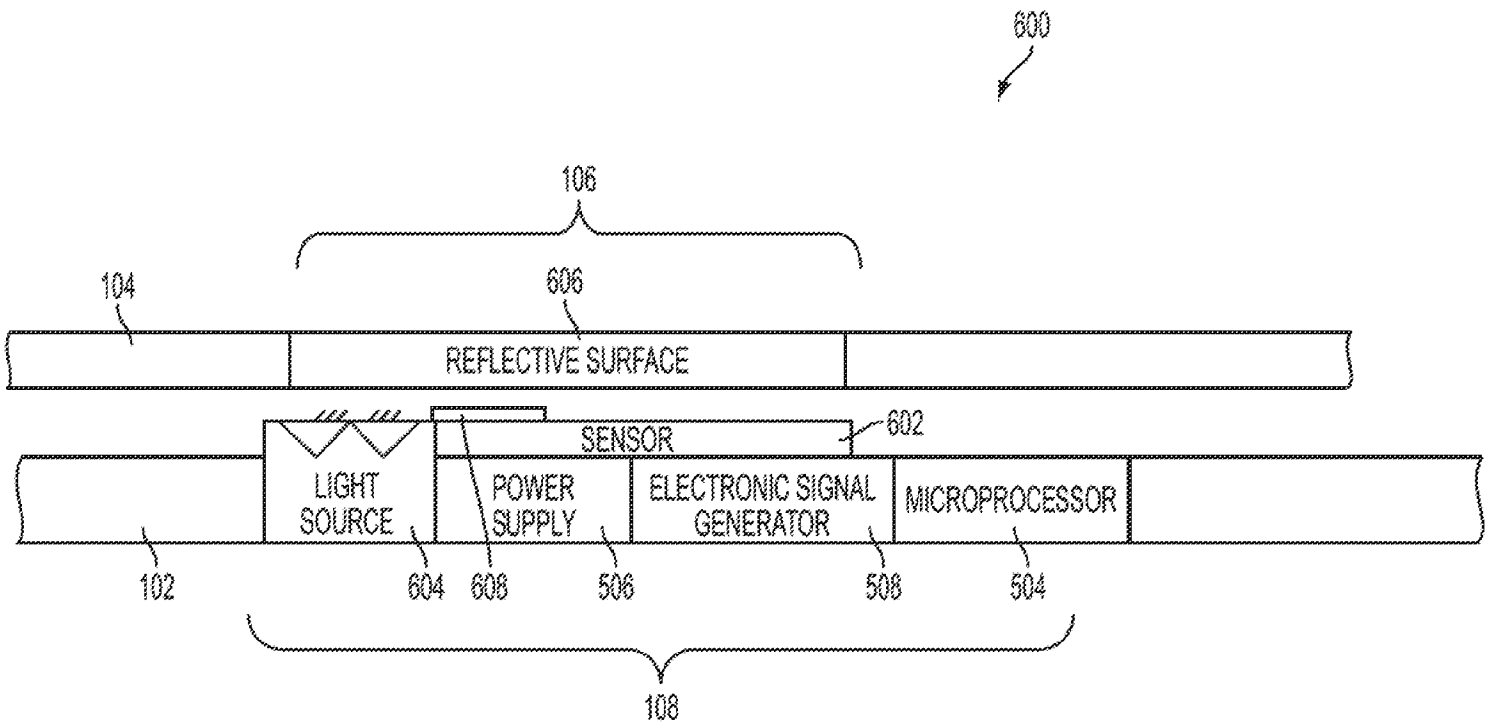
FIG. 6 is a cross-sectional view of part of a tubing assembly for determining a position of a tubing section with an electronic signal generator, according to another aspect.

In additional aspects, the signal generator 108 may be triggered by reflected light. FIG. 6 is a cross-sectional, schematic depiction of a part of tubing assembly 600 having a first tubing section 102 including a signal generator 108 that includes a light sensor 602 and a light source 604. The signal generator 108 additionally includes a power supply 506, a processor 504, and an electronic signal generator 508. The second tubing section 104 can include a reflective surface 606. The light source 604 can be any source capable of emitting detectable light, such as an LED or a laser. The light source 604 can be angled with respect to the first tubing section 102 such that light emitted from the light source 604 bounces off the reflective surface 606 towards the light sensor 602. In some aspects, the light source 604 can be not angled. In such aspects, the light source 604 and/or the reflective surface 606 can be diffuse enough to ensure some light emitted from the light source 604 is received by the light sensor 602. The light source 604 can be monochromatic or polychromatic. The reflective surface 606 can be a specially treated surface of the inner diameter of the second tubing section 104, or can be an element attached to or disposed within a recess of the second tubing section 104. The reflective surface 606 can be configured to be highly reflective and capable of reflecting light from the light source 604 to the light sensor 602 when the signal generator 108 is proximate the detectable portion 106. The reflective surface 606 can be configured to reflect only a particular wavelength of light or a narrow band of wavelengths of light. The processor 504 can be configured to cause the electronic signal generator 508 to create a pressure wave in response to the light sensor 602 detecting light reflected from the reflective surface 606. As the first tubing section 102 is moved relative to the second tubing section 104, the light source 604 and light sensor 602 can pass by the reflective surface 606, resulting in the generation of a pressure wave, indicative of the position of the first tubing section 102 relative to the second tubing section 104. The processor 504 can be configured to generate a pressure wave 512 that includes a special pulsed signal that can be more easily distinguished, at the surface, from other noise. The processor 504 can further be configured to generate a pressure wave 512 that includes a special pulsed signal correlated to the detectable portion 106.

In one aspect, at least two reflective surfaces 606 can be located at different locations along the second tubing section 104. Each of the reflective surfaces 606 can be configured to reflect a different wavelength or a narrow band of wavelengths of light. The narrow bands of wavelengths of light can be non-overlapping, such that no two reflective surfaces 606 reflect any of the same wavelengths of light. The light source 604 can be polychromatic, including at least each of the wavelengths or at least a portion of each of the narrow bands of wavelengths reflected by the reflective surfaces. The processor 504 can be configured to generate a pressure wave 512 that includes a special pulsed signal correlated to which wavelength or narrow band of wavelengths was detected by the light sensor 602. The special pulsed signal would then identify which reflective surface 606 was passed by the signal generator 108, thus enabling precise positioning of the first tubing section 102 relative to the second tubing section 104 at more than one location.

In several aspects, the signal generator 108 can include one or more wipers 608 positioned adjacent one or more of the light source 604, the light sensor 602, and/or the reflective surface 606. The wipers 608 can be configured to clean any debris from the light source 604, the light sensor 602, and/or the reflective surface 606. The wipers 608 can be powered. The wipers 608 can be passive and can be located on the opposite tubing section from the tubing section containing the object to be wiped.

Figure 7A:
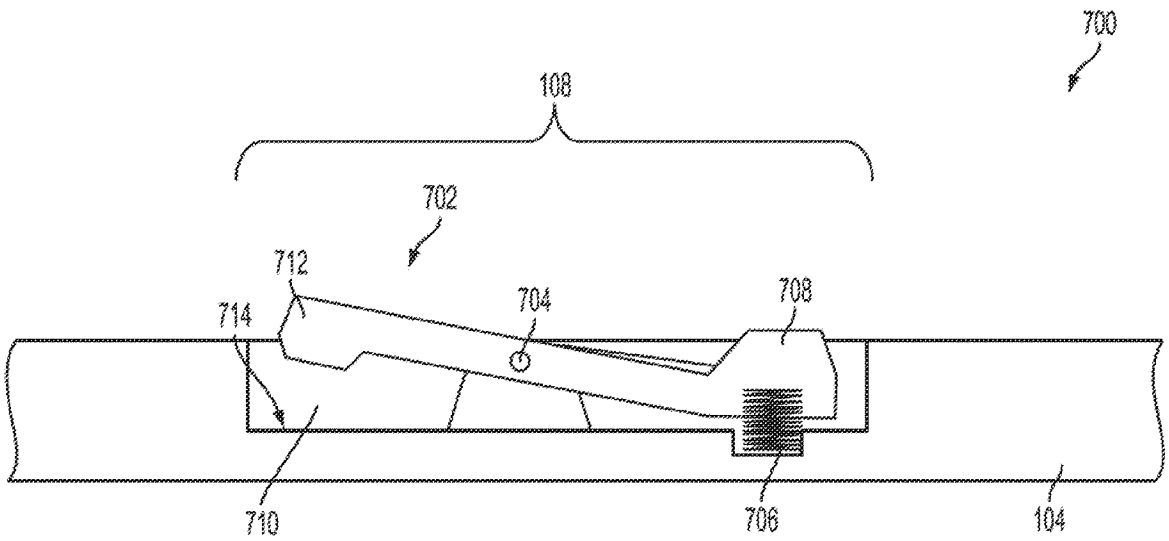
FIG. 7*a* is a cross-sectional view of part of a tubing assembly for determining a position of a tubing section with a spring-biased hammer, according to one aspect.

In some aspects, a signal generator can be a hammer that mechanically impacts a tubing section. FIG. 7*a* depicts a cross sectional view of a tubing assembly 700 having a signal generator 108 that includes a hammer 702 located in a recess 710 of a second tubing section 104. The hammer 702 can include a hammer head 712 located across a pivot 704 from a cam 708. The cam 708 can be spring biased away from the second tubing section 104, such that the hammer head 712 is naturally biased towards a wall 714 of the recess 710 and the cam 708 is naturally biased past the inner diameter of the second tubing section 104. The cam 708 can be configured to engage a detectable portion of a first tubing section, such as a detent mechanism. As the detent mechanism passes the cam 708, it compresses the spring 706, causing the hammer head 712 to move away from the wall 714. Once the detent mechanism passes the cam 708, the cam 708 can be released, allowing the hammer head 712 to fall against the wall 714, as seen in FIG. 7*b*.

Figure 7B:
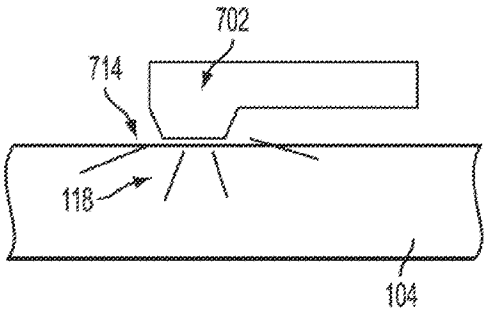
FIG. 7*b* is a close-up cross-sectional view of part of the tubing assembly of FIG. 7*a* in which the hammer head of a spring-biased hammer impacts a tubing section, according to one aspect.

FIG. 7*b* depicts a close-up cross sectional view of part of the tubing assembly 700 of FIG. 7*a*. A pressure wave 118 is generated in response to the hammer head 712 falling against the wall 714.

Figure 8:
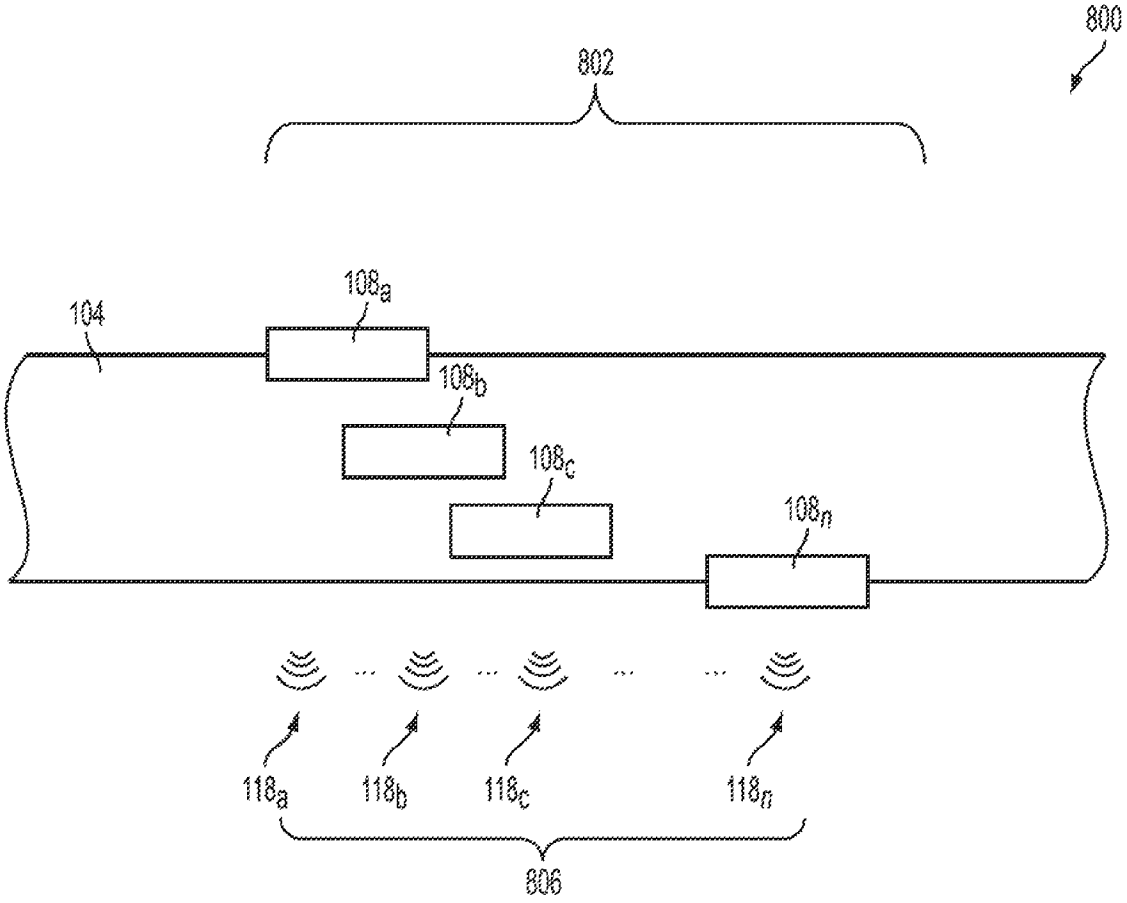
FIG. 8 is a schematic illustration of a tubing assembly for determining a position of a tubing section with multiple signal generators, according to one aspect.

In some aspects, a signal indicative of a position of a tool or tubing section can include a pattern of pressure waves. FIG. 8 depicts a block diagram of a portion of a tubing assembly 800 including a second tubing section 104 having a pattern of signal generators 802. The pattern of signal generators 802 can include a plurality of signal generators 108*a*-108*n*. As a detectable portion 106 of a first tubing section 102 passes by the pattern of signal generators 802, each of the signal generators 108*a*-108*n* can generate its own pressure wave 118*a*-118*n*. As the first tubing section 102 passes the second tubing section 104 at a relatively constant rate, the pressure waves 118*a*-118*n* create a pattern of pressure waves 806. The pattern of pressure waves 806 can be conducted to a hydrophone 114. The particular pattern of pressure waves 806 received by a hydrophone 114 can be indicative of the location of the first tubing section 102 with respect to the second tubing section 104. Additionally, multiple, unique patterns of signal generators 802 can be utilized in order to more precisely locate the position of first tubing section 102 with respect to the second tubing section 104 at multiple locations.

Figure 9:
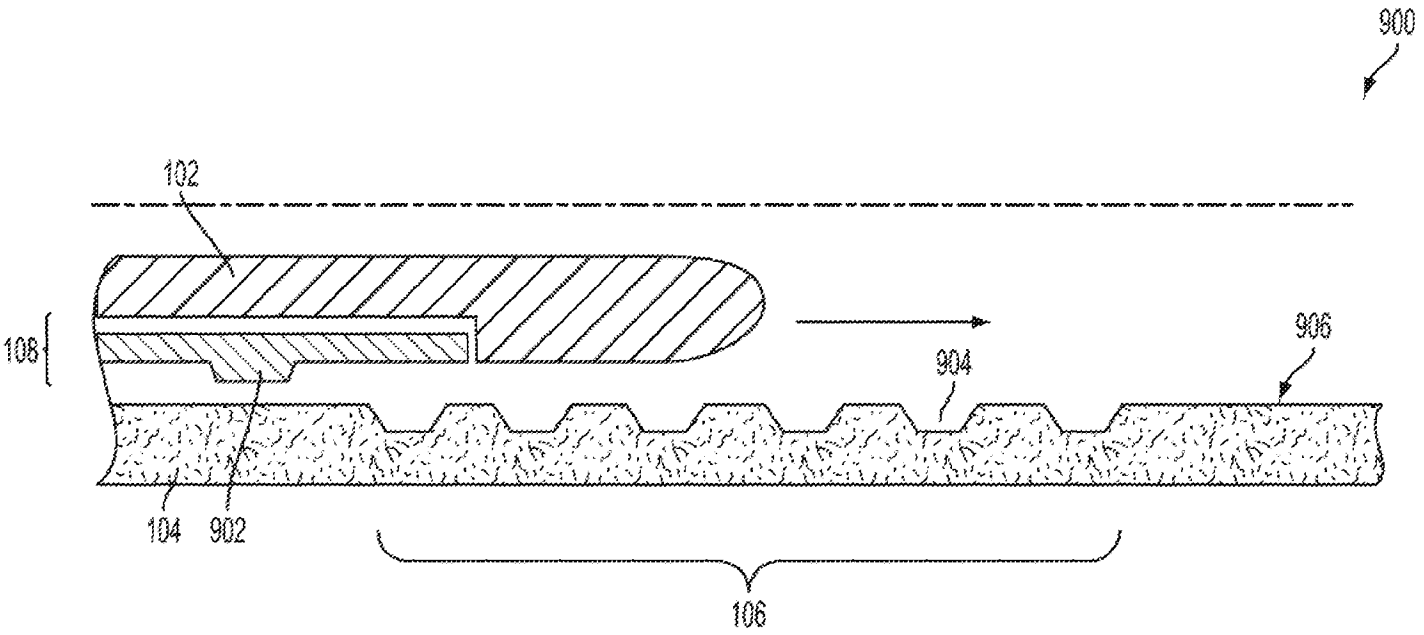
FIG. 9 is a cross-sectional view of part of a tubing assembly for determining a position of a tubing section with a series of grooves, according to one aspect.

FIG. 9 is a cross-sectional depiction of one aspect of a tubing assembly 900 having a detectable portion 106 including a series of grooves 904. The series of grooves 904 can be incorporated into the inner diameter 906 of a second tubing section 104. A first tubing section 102 can include a signal generator 108 including a detent mechanism 902 configured to be biased against the inner diameter 906 of the second tubing section 104. As the first tubing section 102 moves with respect to the second tubing section 104, the detent mechanism 902 can fall into each of the grooves 904 of the detectable portion 106. A pressure wave can be generated in response to the detent mechanism 902 falling into a groove 904. The pattern of grooves 904 within the detectable portion 106 can be correlated to a pattern of pressure waves caused by the movement of the signal generator 108 along the detectable portion 106. In some aspects, multiple detectable portions 106 can be used in a tubing assembly 900, each with a unique pattern of grooves 904 capable of resulting in a unique pattern of pressure waves. In these aspects, a first location of the first tubing section 102 with respect to the second tubing section 104 can be associated with a first pattern of pressure waves and a second location of the first tubing section 102 with respect to the second tubing section 104 can be associated with a second pattern of pressure waves. The first and second patterns of pressure waves can allow different positions in the wellbore to be identified.

Figure 10A:
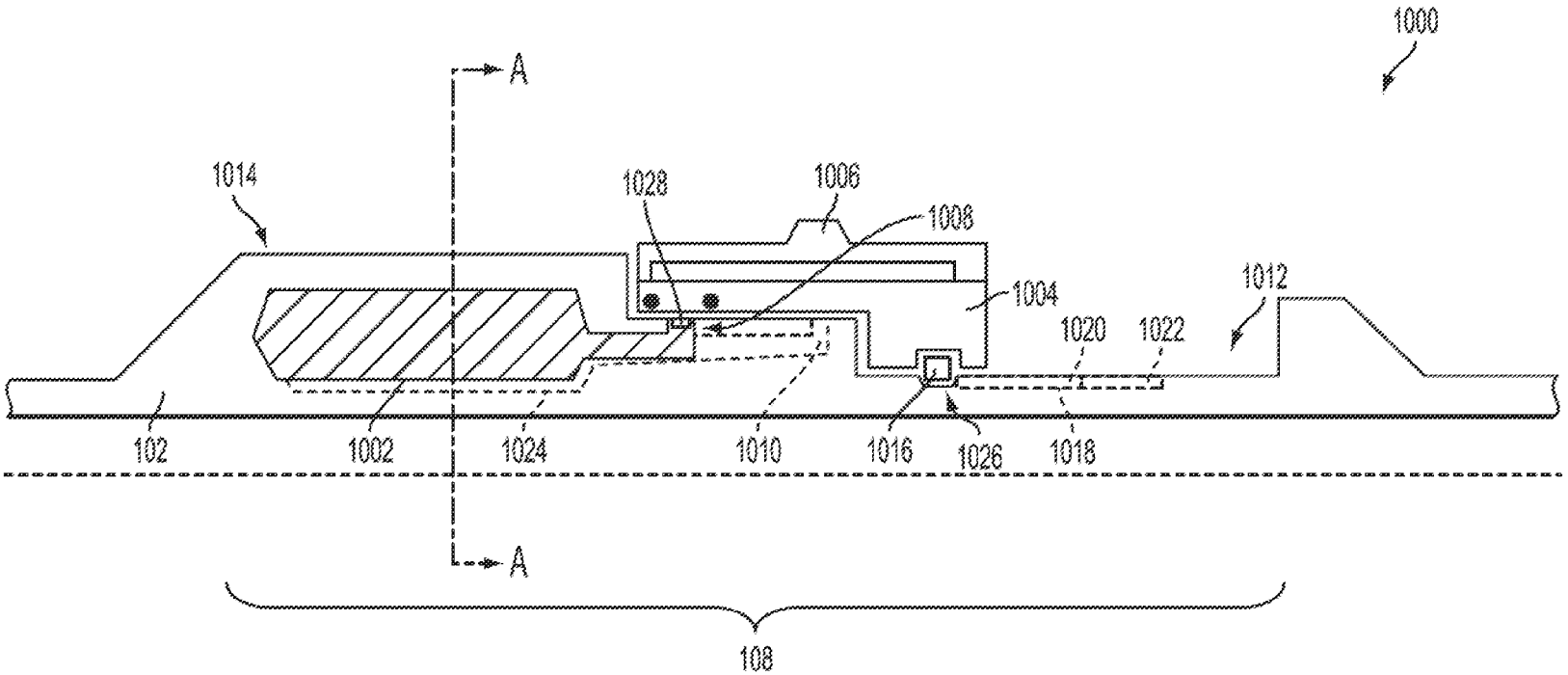
FIG. 10*a* is a cross-sectional view of part of a tubing assembly for determining a position of a tubing section with an atmospheric chamber, according to one aspect.

In additional aspects, a signal indicative of a position of a tool or tubing section may be generated by flooding atmospheric chambers. FIG. 10*a* depicts a cross sectional view of an aspect of a tubing assembly 1000 having a signal generator 108 including an atmospheric chamber 1002. The atmospheric chamber 1002 can be filled with air or other fluid and can be known as a fluid chamber. The atmospheric chamber 1002 can be located on or in a first tubing section 102. The atmospheric chamber 1002 can include a port 1008. The port 1008 can be sealed by a sleeve 1004. The sleeve 1004 can be axially movable within a recess 1012 of the first tubing section 102 to cover and uncover the port 1008. The sleeve 1004 includes a projection 1006 extending past an outer diameter 1014 of the first tubing section 102. An inner diameter, profile, or projection of a second tubing section 104 can indicate on the projection 1006, causing the sleeve to move axially away from the atmospheric chamber 1002, thus uncovering the port 1008. Uncovering of the port 1008 can cause the atmospheric chamber 1002 to be flooded. A perceptible pressure wave can be created in response to flooding of the atmospheric chamber 1002. In some aspects, the port 1008 can include an insert 1028 configured to tailor the pressure wave in response to fluid rushing into or out of the atmospheric chamber 1002. The insert 1028 can be a whistle, a buzzing device (e.g., similar to a kazoo), or other such device capable of producing a recognizable pressure wave in response to fluid flow.

In some aspects, the first tubing section 102 can include a plurality of atmospheric chambers 1002, 1024, each having ports 1008, 1010, respectively. In some such aspects, the ports 1008, 1010 are all covered and uncovered by the same sleeve 1004. In some such aspects, a first atmospheric chamber 1002 would have a first port 1008 and a second atmospheric chamber 1024 can have a second port 1010, spaced apart from the first port 1008 such that the first port 1008 and second port 1010 become uncovered by the sleeve 1004 sequentially, at different times. The first port 1008 and second port 1010 can be spaced apart axially. The sequential flooding of the atmospheric chamber 1002 can result in a unique pattern of pressure waves. In such aspects, the location of the first tubing section 102 with respect to the second tubing section 104 can be precisely known based on which pattern of pressure waves is detected.

Figure 10B:
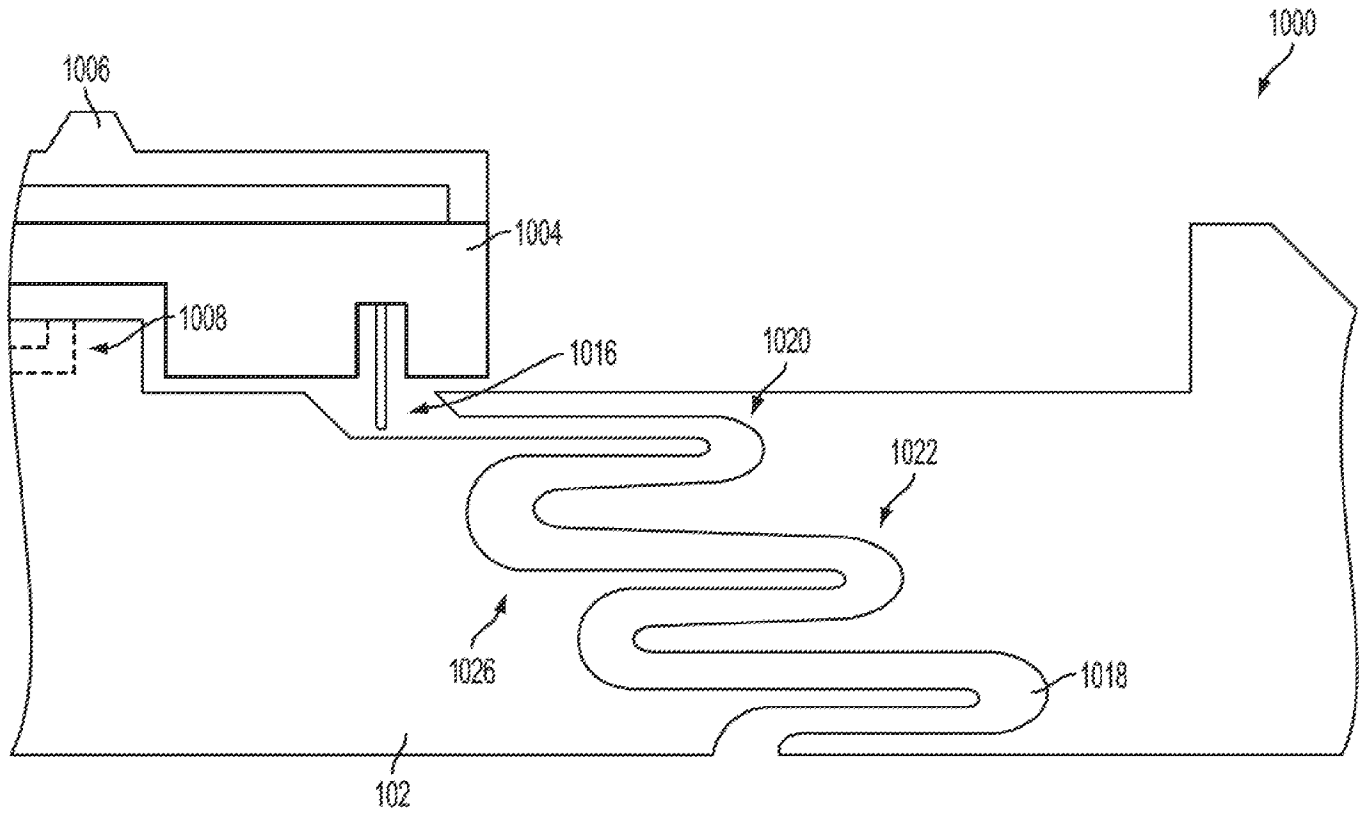
FIG. 10*b* is a close-up, alternate view of part of the tubing assembly of FIG. 10*a* with a J-slot in an external surface of a tubing section, according to one aspect.

FIG. 10*b* is a close-up, alternate view of the tubing assembly 1000 of FIG. 10*a*, showing a J-slot 1018 in an external surface of the first tubing section 102. In some aspects, as seen in FIGS. 10*a* and 10*b*, the sleeve 1004 can include a dog 1016 that fits within the J-slot 1018. The sleeve 1004 can be biased to a covering position where the sleeve covers a first port 1008 and a second port 1010. The J-slot 1018 can be shaped to have a plurality of limiting stops, such as a first stop 1020 and a second stop 1022, located at successively further distances from the covering position. The J-slot 1018 functions to limit the range of travel of the sleeve 1004 to successively longer ranges of travel. In one aspect, the first stop 1020 is located closer to the covered position than the second stop 1022. Upon reaching a limiting stop 1020, 1022 in the J-slot 1018, the sleeve 1004 or projection 1006 can compress or move to be positioned within the outer diameter 1014 of the first tubing section 102. In some aspects, the detectable portion 106 can first cause the sleeve 1004 to travel to a first position, limited by the first stop 1020 in the J-slot 1018, in which the first port 1008 is uncovered, allowing the atmospheric chamber 1002 associated therewith to flood. After the detectable portion 106 has passed, the sleeve 1004 can travel to a reset position 1026 in the J-slot 1018. The reset position 1026 can be the covered position, or can be a position between the covered position and the first position. Thereafter, when a detectable portion 106 engages the projection 1006, the sleeve 1004 travels to a second position, limited by a second stop 1022 in the J-slot 1018, in which the second port 1010 is uncovered, allowing a second atmospheric chamber 1024 associated therewith to flood.

Figure 11:
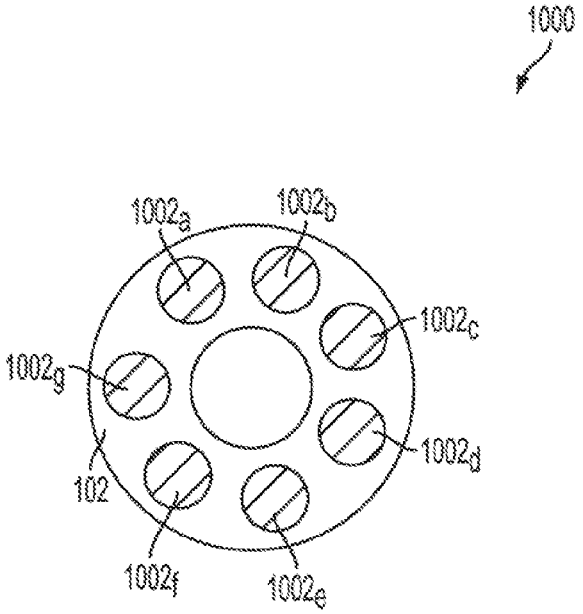
FIG. 11 is an alternate cross-sectional view of part of the tubing assembly of FIG. 10*a* with multiple atmospheric chambers, according to one aspect.

FIG. 11 is a cross sectional depiction of an aspect of the tubing assembly 1000 of FIG. 10*a* taken across line A:A. The first tubing section 102 is shown having multiple atmospheric chambers 1002*a*-1002*g*.

A signal generator 108 that operates by flooding an atmospheric chamber 1002 can be desirable as it can be more resistant to negative effects of debris.

Figure 12A:
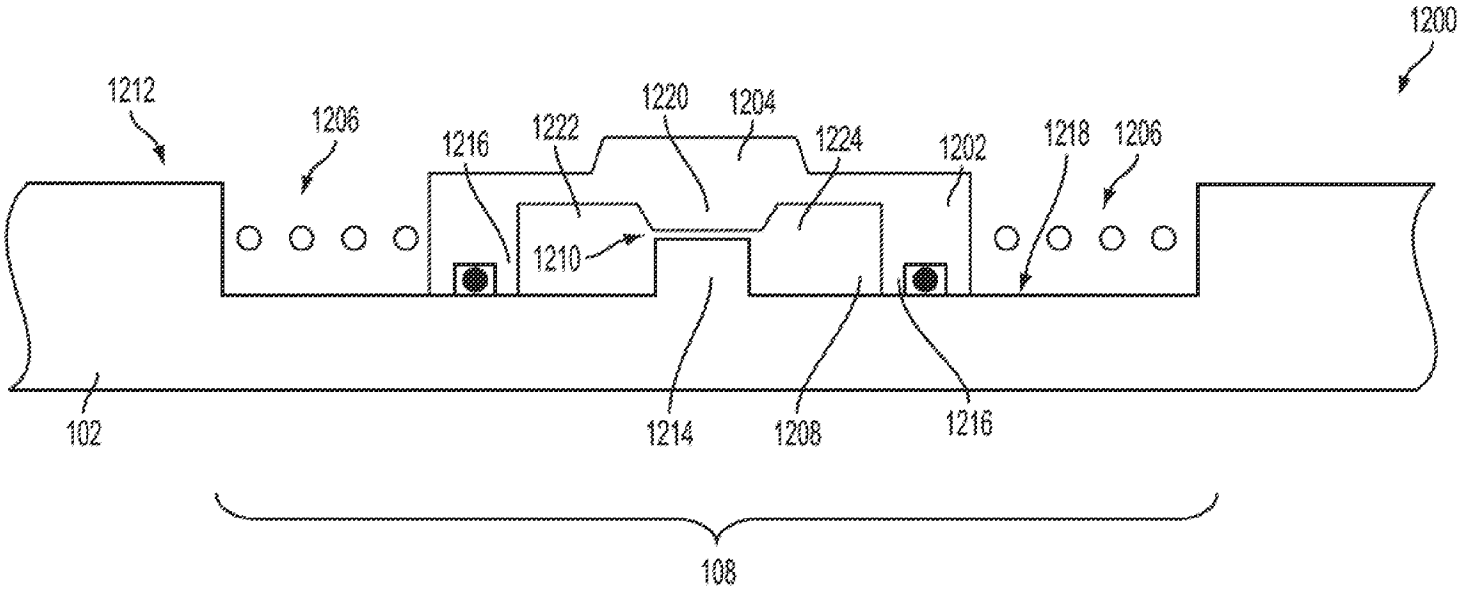
FIG. 12*a* is a cross-sectional view of part of a tubing assembly for determining a position of a tubing section with a double ended collet, according to one aspect.

In some aspects, a signal indicative of a position of a tool or tubing section can be generated by a collet having a fluid-filled chamber. FIG. 12*a* is a cross sectional depiction of an aspect of a tubing assembly 1200 utilizing a signal generator 108 having a collet 1202 and a chamber 1208 with a first side 1222 and a second side 1224. A first tubing section 102 can include a collet 1202. The collet 1202 is depicted as a double ended collet, although other types of collets can be used. The collet 1202 can include an external projection 1204 that extends past an outer diameter 1212 of the first tubing section 102. The collet 1202 can be positioned in a recess 1218 of the first tubing section 102. The collet 1202 can include two legs 1216 forming a chamber 1208 between the collet 1202 and the first tubing section 102. The legs 1216 can include o-rings or other seals to ensure the chamber 1208 is tightly sealed such that the total volume of the chamber 1208 is substantially the same despite axial displacement of the collet 1202. The chamber 1208 is substantially sealed and contains a fluid. The chamber 1208 can be known as a fluid chamber. Springs 1206 can be positioned within the recess 1218 to bias the collet 1202 in a neutral position, as shown in FIG. 12*a*. When in the neutral position, an internal projection 1220 of the collet 1202 is located adjacent a block 1214 within the chamber 1208. A pathway 1210 of restricted flow is located between the block 1214 and the internal projection 1220. In the neutral position, the block 1214 and the internal projection 1220 separate the chamber 1208 into a first side 1222 and a second side 1224, fluidly isolated except for the pathway 1210 of restricted flow. The pathway 1210 can include a valve. The pathway 1210 can include a small annulus. The pathway 1210 can be considered a displacement-selectively restrictive pathway because as the collet 1202 is displaced axially, the pathway 1210 changes from being highly restrictive to being less highly restrictive, as described in further detail below.

A detectable portion 106, such as an inner diameter, profile, or projection of a second tubing section 104, can indicate on the external projection 1204, causing the collet 1202 to move axially within the recess 1218. As the collet 1202 is pushed axially (e.g., from left to right as seen in FIG. 12*a*), fluid within the chamber 1208 will move from one side to the other (e.g., from the first side 1222 to the second side 1224) through the pathway 1210. Because the chamber 1208 is sealed, fluid must flow between the first side 1222 and second side 1224 as the collet 1202 moves axially within the recess 1218. The pathway 1210 can be configured to substantially restrict fluid flow only while the collet 1202 is not axially displaced beyond a predetermined set distance. When the collet 1202 is not axially displaced beyond the set distance, the pathway 1210 will restrict fluid flow between the first side 1222 and the second side 1224. When the collet is in this first position, the pathway 1210 has a relatively high fluid resistance (i.e., resistance to fluid flow). Because the pathway 1210 allows only restricted flow between the first side 1222 and the second side 1224, the collet 1202 will oppose being moved axially within the recess 1218. Pressure will build up against the collet 1202. After sufficient pressure is applied to the collet 1202, the collet 1202 will be moved to a tripped position (e.g., axially displaced to a predetermined set distance) wherein the internal projection 1220 passes the block 1214 enough to widen the pathway 1210. When in this tripped position, the pathway 1210 has a relatively low fluid resistance. The internal projection 1120 and/or the block 1214 can be shaped to allow the pathway 1210 to become free-flowing after the collet 1202 has been displaced axially by a sufficient amount. When the collet 1202 is in a tripped position (e.g., as seen in FIG. 12*b*), the pathway 1210 allows significantly more fluid flow than in a neutral position (e.g., as seen in FIG. 12*a*).

Figure 12B:
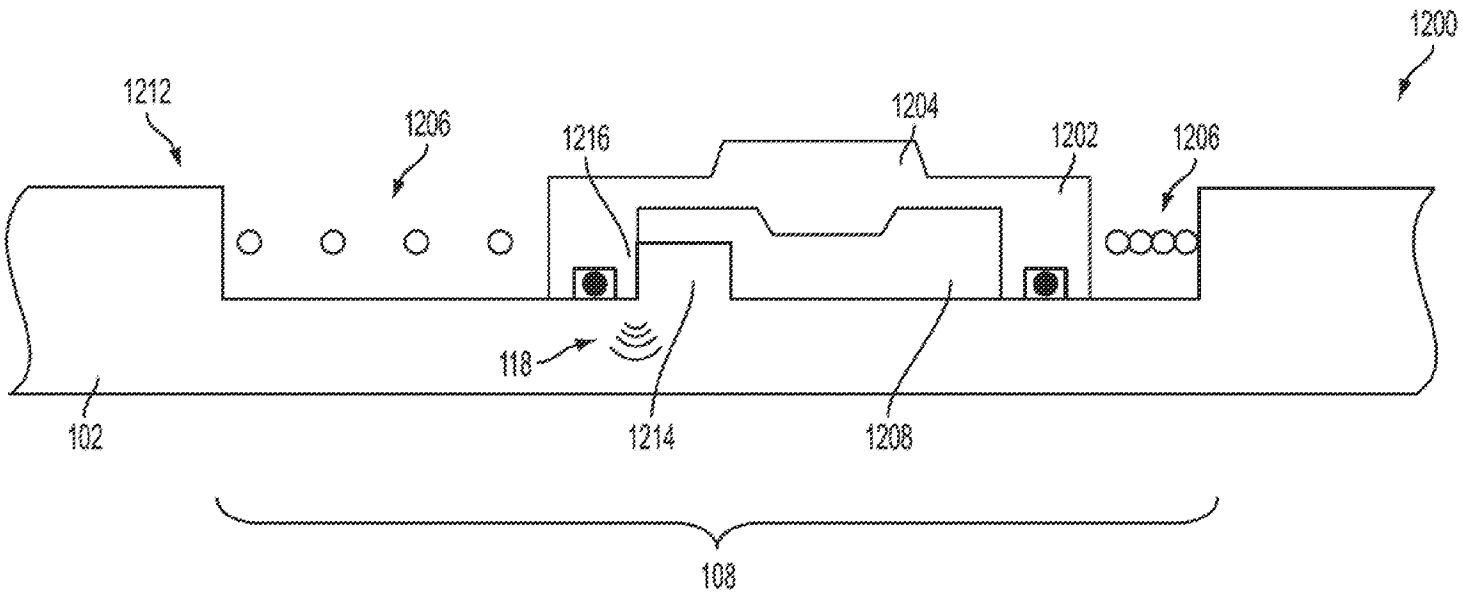
FIG. 12*b* is a cross-sectional view of part of a tubing assembly for determining a position of a tubing section with a double ended collet, according to one aspect.

FIG. 12*b* is a cross sectional depiction of the aspect of tubing assembly 1200 of FIG. 12*a*, showing the collet 1202 immediately after being moved to a tripped position. Once the collet 1202 is in a tripped position, the built-up pressure will be quickly and forcefully released, causing one of the two legs 1216 to contact the block 1214 with sufficient force to generate a pressure wave 118. After the detectable portion 106 passes the external projection 1204 of the collet 1202, the collet 1202 can be biased back to its neutral position by springs 1206.

In some aspects, the signal generator 108 can be configured to generate a pressure wave 118 in response to the detectable portion 106 passing the collet 1202 in either axial direction (e.g., left to right or right to left, as seen in FIGS. 12*a*-12*b*). In some aspects, the signal generator 108 can be designed to only generate a pressure wave 118 in response to the detectable portion 106 passing the collet 1202 in only one of two axial directions (e.g., left to right or right to left, as seen in FIGS. 12*a*-12*b*).

A signal generator 108 as described above in reference to FIGS. 12*a*-12*b* can be beneficial as it can create a significant pressure wave in or from a first tubing section without substantially jarring a second tubing section.

Figure 13:
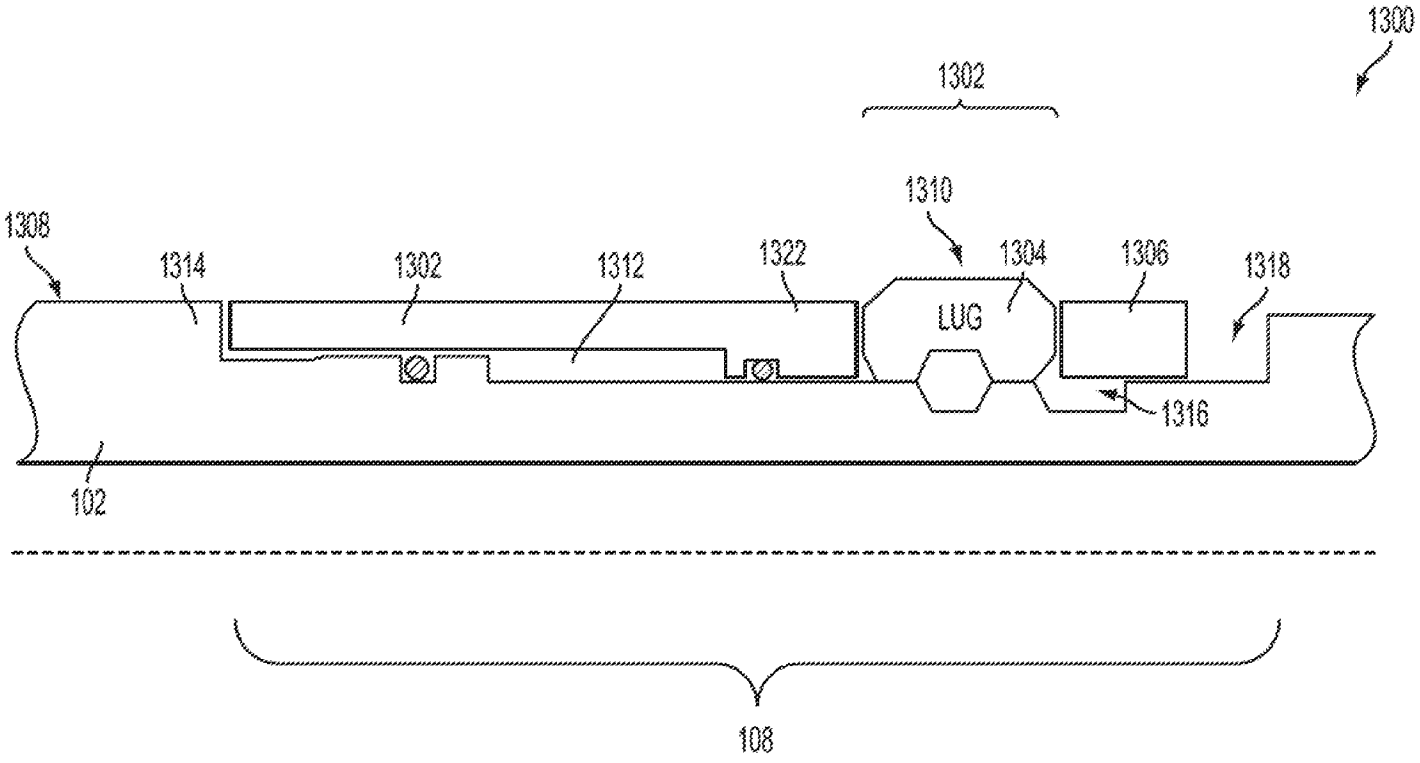
FIG. 13 is a cross-sectional view of part of a tubing assembly for determining a position of a tubing section with a sliding hammer, according to one aspect.

In some aspects, a signal generator 108 can include a sliding hammer 1302 biased by a sealed chamber 1312. FIG. 13 is a cross sectional depiction of an aspect of a tubing assembly 1300 having a signal generator 108 that includes a sliding hammer 1302. The sliding hammer 1302 can slide in an axial direction. The sliding hammer 1302 can be located in a recess 1318 of a first tubing section 102. The sliding hammer 1302 can include a window 1320 between a first portion 1322 and second portion 1306. A lug 1304 can be located within the window 1320. A sealed, atmospheric chamber 1312 can be located between the sliding hammer 1302 and the first tubing section 102. The atmospheric chamber 1312 can be sealed with O-rings. The lug 1304 can include a projection 1310.

A detectable portion 106, such as an inner diameter, profile, or projection of a second tubing section 104, can interact with the projection 1310 to cause the lug 1304 to be pushed axially. As the lug 1304 is pushed axially (e.g., from left to right as seen in FIG. 13), it causes the sliding hammer 1302 to move in the same direction. As the sliding hammer 1302 moves, the volume of the atmospheric chamber 1312 expands or attempts to expand. The atmospheric chamber 1312 is filled with a fluid that resists an increase in volume of the atmospheric chamber 1312. The resistance to the volume increase provides a biasing force that opposes the movement of the sliding hammer 1302 (e.g., provides a biasing force pulling the sliding hammer 1302 from right to left as seen in FIG. 13). The atmospheric chamber 1312 can be filled with an incompressible fluid. At a certain point, the lug 1304 falls within a recess 1316 of the first tubing section 102, allowing the detectable portion 106 to move over the projection 1310 without pushing the lug 1304 or sliding hammer 1302 further. When the detectable portion 106 passes the projection 1310, the biasing force from the atmospheric chamber 1312 is sufficient to pull the lug 1304 out of the recess 1316, allowing the sliding hammer 1302 to contact the a shoulder 1314 of the first tubing section 102. A perceptible pressure wave can be generated in response to the sliding hammer 1302 contacting the shoulder 1314 with sufficient force. The shoulder 1314 can include portion of the first tubing section 102 contacted by the sliding hammer 1302, without limitation to the size, shape, or makeup of the shoulder.

In some aspects, the atmospheric chamber 1312 can be smaller in volume for deeper wells. In some aspects, another biasing device can be used in place of the atmospheric chamber 1312, such as a spring or an elastomeric piece. In some aspects, another part can replace the lug 1304, such as a collet.

Figure 14:
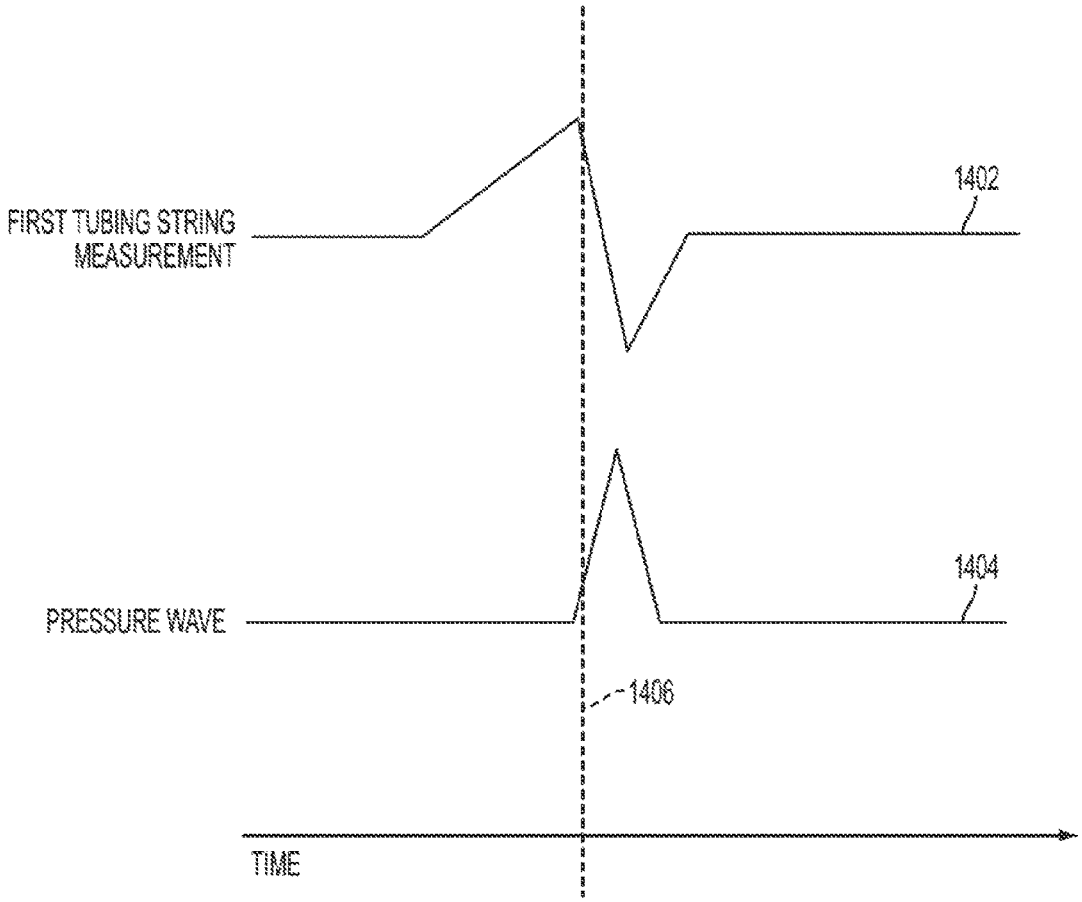
FIG. 14 is a graphical representation of measurements from a tubing assembly for determining a position of a tubing section according to one aspect.

In some aspects, a signal indicative of a position of a tool or tubing section can be validated. FIG. 14 is a graphical depiction of both a first tubing section measurement 1402 and a pressure wave measurement 1406, with respect to time, according to various aspects described herein. The graph of the first tubing section measurement 1402 depicts the tension and compression of the first tubing section 102 as the detectable portion 106 mechanically engages a signal generator 108, according to various aspects described herein. The first tubing section measurement 1402 can be a weight measurement. The graph of the pressure wave 1404 depicts receipt of a pressure wave 118 by the hydrophone 114 or other device. In some aspects, a signal generator 108 can generate a pressure wave 118 at approximately time 1408. A processor 116 can be configured to compare the timing of a first tubing section measurement 1402 and a pressure wave measurement 1406 to determine whether or not to update a display 120 or perform another function. In one aspect, the processor 116 is configured to update the display 120 or perform another action if a pressure wave 118 is detected in conjunction with an appropriate first tubing section measurement 1402 (e.g., with detecting an appropriate tension followed by a compression). The processor 116 can be configured to ignore other pressure wave 118 detections. The processor 116 can thusly be configured to validate any received pressure waves 118.

Figure 15:
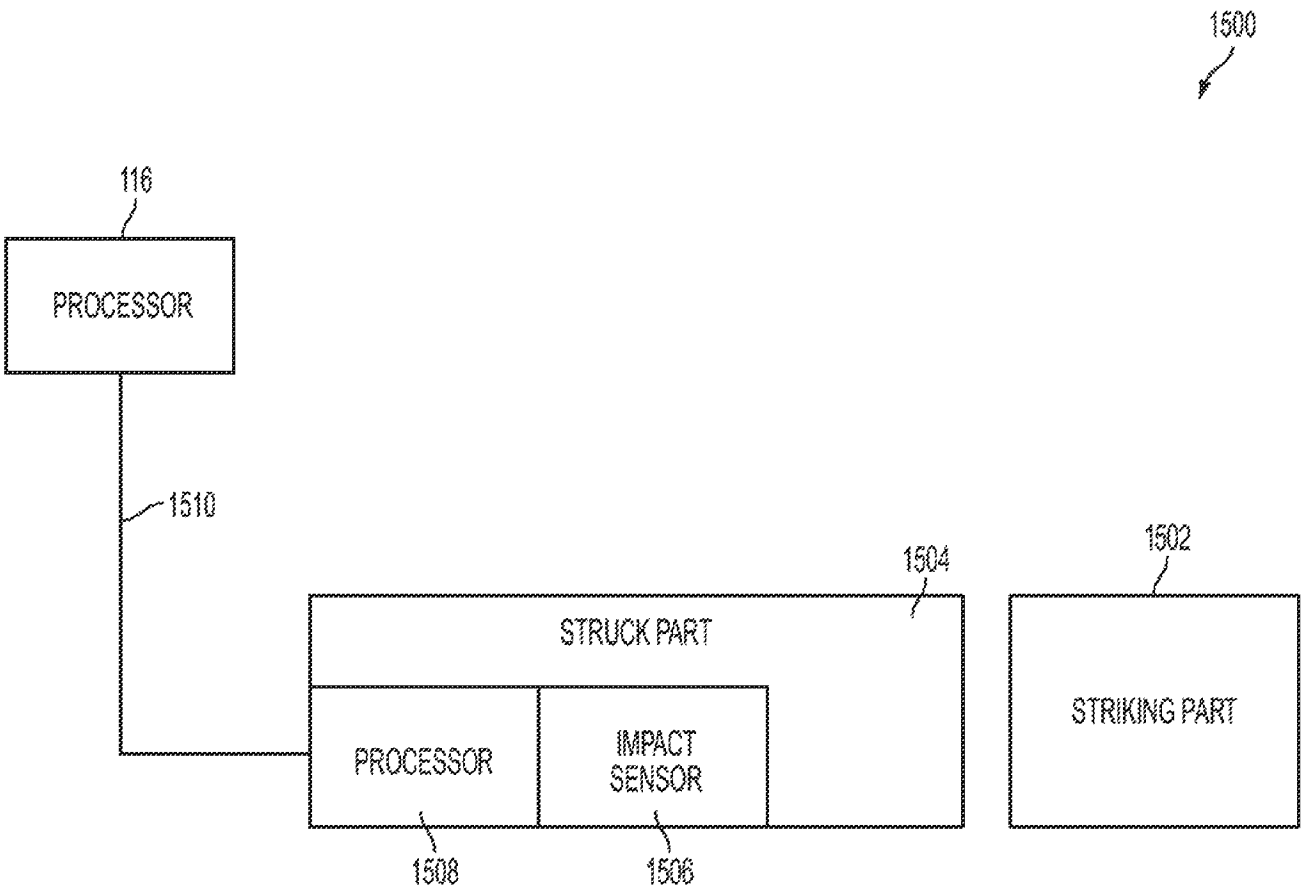
FIG. 15 is a block diagram of a system for determining a position of a tubing section according to one aspect.

In additional aspects, a signal indicative of a position of a tool or tubing section can originate as a mechanical action that is converted into an electrical signal that is electrically conducted to the surface from downhole. FIG. 15 is a schematic depiction of an aspect of a position indicator system 1500 having a striking part 1502 and a struck part 1504. The striking part 1502 can strike the struck part 1504 to mechanically generate a pressure wave 118 (e.g., the aspects depicted in FIGS. 2-4, 7*a*-7*b*, 9, 12*a*-13). For example, the striking part 1502 can be a slidable mass 214 and the struck part 1504 can be a solid shoulder 220 of a second tubing section 104.

In some aspects, the struck part 1504 can include an impact sensor 1506 connected to a processor 1508. The impact sensor 1506 can detect generation of a pressure wave 118. The impact sensor 1506 can be a strain gauge. The impact sensor 1506 can detect the generation of a pressure wave 118 in response to the striking part 1502 striking the struck part 1504. Upon detection of the pressure wave 118, the processor 1508 can send an electrical signal along an electrical conductor 1510 to a processor 116 at the surface. The electrical conductor 1510 can be at least partially contained within the first tubing section 102.

In some aspects, the impact sensor 1506 includes electrical contacts that create an open circuit that is at least momentarily closed in response to the striking part 1502 striking the struck part 1504.

A single tubing assembly can include one or more of the aspects described herein. As used herein, various signal generators 108 and detectable portions 106 located on or in a first tubing section 102 and second tubing section 104, respectively, can be located on or in a second tubing section 104 and first tubing section 102, respectively, and vice versa.

In some aspects, multiple signal generators 108 are used in a pattern to generate a discernible pattern of pressure waves 118. In such aspects, multiple detectable portions 106 can be used with a single signal generator 108 to generate a discernible pattern of pressure waves 118.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

Claims Bank

The following banked claims are part of the detailed description and are provided for illustrative purposes only.

Banked Claim 1. An assembly comprising: a first tubing section including a detent mechanism positioned on an outer surface of the first tubing section; a second tubing section including a slidable mass coupled to a biasing device positioned on an inner surface of the second tubing section, wherein the first tubing section is positionable relative to the second tubing section such that the detent mechanism contacts the slidable mass as the first tubing section passes through the second tubing section, wherein the biasing device is responsive to the detent mechanism contacting the slidable mass by compressing, wherein the detent mechanism is responsive to the biasing device being compressed beyond a pre-determined threshold by moving past and releasing the slidable mass, wherein the slidable mass is responsive to being released by the detent mechanism by contacting a solid shoulder of the second tubing section.

Banked Claim 2. The assembly of banked claim 1, wherein the biasing device is one of a spring or a Belleville washer.

Banked Claim 3. The assembly of banked claim 1, wherein the biasing device is a spring.

Banked Claim 4. The assembly of banked claim 1, wherein the detent mechanism is selected from the group consisting of a snap ring, a collet, and a spring loaded detent.

Banked Claim 5. The assembly of banked claim 1, wherein the detent mechanism includes a first projection that extends beyond the outer surface of the first tubing section.

Banked Claim 6. The assembly of banked claim 5, wherein the slidable mass includes a complementary second projection that extends beyond the inner surface of the second tubing section and is complementary to the first projection.

Banked Claim 7. The assembly of banked claim 1, wherein the slidable mass is repeatedly responsive to being released by the detent mechanism by contacting the solid shoulder of the second tubing section.

Banked Claim 8. The assembly of banked claim 1, wherein the first tubing section is a work string including a tool and the second tubing section is a completion string.

Banked Claim 9. The assembly of banked claim 1, wherein the biasing device is responsive to the slidable mass being released by the detent mechanism by exerting a force against the slidable mass.

Banked Claim 10. A method of determining a position of a tubing section at least partially disposed within a wellbore, the method comprising: disposing a first tubing section in the wellbore, the first tubing section including a slidable mass coupled to a biasing device positioned on an interior surface of the first tubing section; disposing a second tubing section relative to the first tubing section in the wellbore, the second tubing section including a detent mechanism positioned around an outer surface of the second tubing section; manipulating the second tubing section relative to the wellbore such that the detent mechanism contacts the slidable mass and compresses the biasing device; releasing the slidable mass in response to the biasing device being compressed beyond a pre-determined threshold; and driving the slidable mass into a solid shoulder of the second tubing section in response to releasing the slidable mass.

Banked Claim 11. The method of banked claim 10, further comprising, generating a sound wave in response to driving the slidable mass into the solid shoulder of the second tubing section and transmitting the sound wave through an acoustically conducting medium to a surface of the wellbore.

Banked Claim 12. The method of banked claim 11, wherein the acoustically conducting medium is the completion fluid.

Banked Claim 13. The method of banked claim 11, further comprising receiving by a receiver device the sound wave at the surface of the wellbore.

Banked Claim 14. The method of banked claim 10, further comprising uncompressing the biasing device when the slidable mass is released.

Banked Claim 15. The method of banked claim 14, further comprising forcing the slidable mass along an axis as the biasing device expands.

Banked Claim 16. An assembly comprising: a first tubing section including a detent mechanism positioned on an outer surface of the first tubing section; a second tubing section including a slidable mass coupled to a biasing device positioned on an inner surface of the second tubing section, wherein the first tubing section is positionable relative to the second tubing section such that the detent mechanism contacts the slidable mass as the first tubing section passes through the second tubing section, wherein the biasing device is responsive to the detent mechanism contacting the slidable mass by compressing, wherein the detent mechanism is responsive to the biasing device being compressed beyond a pre-determined threshold by releasing the slidable mass, and wherein the slidable mass is responsive to being released by the detent mechanism by contacting a solid shoulder of the second tubing section.

Banked Claim 17. The assembly of banked claim 16, wherein the detent mechanism is selected from the group comprising a snap ring, a collet, and a spring loaded detent.

Banked Claim 18. The assembly of banked claim 16, wherein the biasing device is one of a spring or a Belleville washer.

Banked Claim 19. The assembly of banked claim 16, wherein the detent mechanism is responsive to the biasing device being compressed beyond the pre-determined threshold by releasing the slidable mass by pushing past the slidable mass.

Banked Claim 20. The assembly of banked claim 16, wherein the biasing device is responsive to the slidable mass being released by the detent mechanism by contacting exerting a force against the slidable mass as the biasing device expands.

Banked Claim 21. The assembly of banked claim 16, wherein the first tubing section is a work string having a tool and the second tubing section is a completion string, and wherein the detent mechanism is responsive to the biasing device being compressed beyond the pre-determined threshold by releasing the slidable mass in response to the tool being positioned at a specific location relative to the completion string.

Banked Claim 22. An assembly comprising: a first tubing section including a signal generator and a weigh down collet; a second tubing section including a detectable portion and an indicator; wherein the signal generator is responsive to the detectable portion to generate a pressure wave; and wherein the weigh down collet is responsive to the indicator.

Banked Claim 23. The assembly of banked claim 22 wherein the signal generation device includes an electronic signal generator.

Banked Claim 24. The assembly of banked claim 23 wherein the detectable portion includes a magnet and the signal generator includes a sensor responsive to the magnet.

Banked Claim 25. A method of determining a position of a tubing section at least partially disposed within a wellbore, the method comprising: positioning a first tubing section having a weigh down collet and a signal generator relative to a second tubing section having a detectable portion and an indicator; maneuvering the first tubing section relative to the second tubing section; detecting an interaction between the weigh down collet and the indicator; detecting a pressure wave generated by the signal generator in response to passing the detectable portion; determining the position of the first tubing section with respect to the second tubing section from both the detection of the interaction and the detection of the pressure wave.

Banked Claim 26. A method of determining a position of a tubing section at least partially disposed within a wellbore, the method comprising: disposing a first tubing section in the wellbore, the first tubing section including a signal generator positioned on an interior surface of the first tubing section; disposing a second tubing section relative to the first tubing section in the wellbore, the second tubing section including a detectible portion; manipulating the second tubing section relative to the wellbore such that a pressure wave is generated by the signal generator in response to passing the detectable portion; and transmitting the sound wave through acoustic conducting medium to be received by a receiver device at the surface of the wellbore.

What is claimed is:

1. An assembly comprising:

a body movable relative to a tubing section;

a sealed fluid chamber including a first side and a second side separated by a restrictive pathway; and a signal generator coupled to the body and operable for detecting a detectable portion of the tubing section in response to relative movement between the body and the tubing section and further operable for generating a pressure wave in response to detection of the detectable portion, the signal generator comprising:

a projection operable for engaging a profile of the detectable portion; and a striking part that is axially displaceable from a first position to a second position to force fluid through the restrictive pathway in response to the projection engaging the profile.

2. The assembly of claim 1, wherein the striking part is operable for generating the pressure wave by physically striking a struck part in response to engagement of the profile by the projection.

3. The assembly of claim 2, wherein: the projection is located on the striking part and the striking part is a collet.

4. The assembly of claim 3, wherein:

the projection is an external projection and the collet additionally includes an internal projection;

the restrictive pathway is at least partially defined by the internal projection;

the internal projection is shaped such that the restrictive pathway has a first fluid resistance when the collet is in a first position and a second fluid resistance when the collet is displaced to a middle position between the first position and the second position, the second fluid resistance being substantially less than the first fluid resistance.

5. A method of determining a position of a body at least partially disposed within a tubing section, the method comprising:

disposing a body within a tubing section, the body and tubing section each having coordinating ones of a detectable portion and a signal generator, the signal generator including a projection operable for engaging a profile of the detectable portion and a striking part that is axially displaceable from a first position to a second position to force fluid through a restrictive pathway that separates a fluid chamber into a first side and a second side in response to the projection engaging the profile, the signal generator operable for detecting the detectable portion in response to relative movement between the body and the tubing section and further operable for generating a pressure wave in response to detection of the detectable portion; and maneuvering the body in relation to the tubing section to cause the signal generator to force fluid through the restrictive pathway and generate a pressure wave.

6. The method of claim 5, additional comprising:

receiving the pressure wave by a processor; and updating a display with information regarding the position of the body in relation to the tubing section.

7. The method of claim 6, wherein the processor is disposed within a wellbore and the receiving includes registering the pressure wave by an impact sensor, additionally comprising;

generating an electrical signal corresponding to the pressure wave; and transmitting the electrical signal through an electrical conductor disposed within the wellbore to a second processor located external the wellbore.

8. The method of claim 6, additionally comprising;

obtaining a tubing section measurement; and comparing a first timing of the tubing section measurement with a second timing of the pressure wave to confirm that the pressure wave was generated by the signal generator.

9. The method of claim 6, wherein:

the receiving the pressure wave additionally includes receiving a plurality of additional pressure waves by the processor, the plurality of additional pressure waves being generated by the signal generator or one or more additional signal generators;

the pressure wave and the plurality of additional pressure waves together make a pattern of pressure waves including identifying information; and the updating is based on the identifying information.

* * * * *